US009566804B2

(12) United States Patent
Miyabayashi

(10) Patent No.: US 9,566,804 B2
(45) **Date of Patent: *Feb. 14, 2017**

(54) INK JET RECORDING APPARATUS AND INK JET RECORDING METHOD

(71) Applicant: Seiko Epson Corporation, Tokyo (JP)

(72) Inventor: Toshiyuki Miyabayashi, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/008,993

(22) Filed: Jan. 28, 2016

(65) Prior Publication Data

US 2016/0144635 A1 May 26, 2016

Related U.S. Application Data

(63) Continuation of application No. 14/679,312, filed on Apr. 6, 2015, now Pat. No. 9,278,549, which is a continuation of application No. 14/073,121, filed on Nov. 6, 2013, now Pat. No. 9,028,057, which is a continuation of application No. 13/074,441, filed on Mar. 29, 2011, now Pat. No. 8,602,548.

(30) Foreign Application Priority Data

Mar. 30, 2010 (JP) ..... 2010-077936
Dec. 22, 2010 (JP) ..... 2010-285957

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 11/002
See application file for complete search history.

(56) References Cited

U.S. PATENT DOCUMENTS

| | | | | |
|---|---|---|---|---|
| 7,014,285 | B2 | 3/2006 | Tanno | |
| 7,237,889 | B2 | 7/2007 | Suzuki et al. | |
| 7,393,095 | B2 | 7/2008 | Oshima et al. | |
| 8,602,548 | B2 * | 12/2013 | Miyabayashi | B41J 11/0015 347/101 |
| 9,028,057 | B2 * | 5/2015 | Miyabayashi | B41J 11/0015 347/102 |
| 9,278,549 | B2 * | 3/2016 | Miyabayashi | B41J 11/002 |

(Continued)

FOREIGN PATENT DOCUMENTS

| | | |
|---|---|---|
| JP | 2004-002531 A | 1/2004 |
| JP | 2004-216681 A | 8/2004 |
| JP | 2006-181805 A | 7/2006 |

*Primary Examiner* — Alessandro Amari
*Assistant Examiner* — Roger W Pisha, II
(74) *Attorney, Agent, or Firm* — Harness, Dickey & Pierce, P.L.C.

(57) ABSTRACT

An ink jet recording apparatus of the present invention includes a head, a first light source, a second light source. Liquid droplets of a photo-curable ink composition are applied to a recording medium. After one second or less elapses from the time when the liquid droplets are applied to the recording medium, the liquid droplets are illuminated with light of the first light source. After 0.1 second or more and one second or less elapses from the time when the liquid droplets are illuminated with light of the first light source, the liquid droplets are illuminated with light of the second light source.

10 Claims, 3 Drawing Sheets

(56) References Cited

U.S. PATENT DOCUMENTS

| | | | |
|---|---|---|---|
| 2004/0050292 | A1 | 3/2004 | Nakajima et al. |
| 2004/0114016 | A1 | 6/2004 | Yokoyama |
| 2004/0145642 | A1 | 7/2004 | Hoshino et al. |
| 2005/0104946 | A1 | 5/2005 | Siegel |
| 2007/0109382 | A1 | 5/2007 | Lafleche et al. |
| 2007/0216724 | A1 | 9/2007 | Shibata et al. |
| 2008/0068431 | A1 | 3/2008 | Yokoyama |
| 2008/0136858 | A1 | 6/2008 | Ueno |
| 2008/0174648 | A1 | 7/2008 | Nakano et al. |
| 2008/0174649 | A1 | 7/2008 | Nakano et al. |
| 2008/0192100 | A1 | 8/2008 | Nakajima |
| 2009/0135238 | A1 | 5/2009 | Nakajima |
| 2009/0147037 | A1 | 6/2009 | Yokoyama |
| 2009/0237479 | A1 | 9/2009 | Yamashita et al. |
| 2009/0291225 | A1 | 11/2009 | Takabayashi |
| 2010/0075052 | A1 | 3/2010 | Irita |
| 2010/0141724 | A1 | 6/2010 | Nakajima |
| 2010/0165041 | A1 | 7/2010 | Sugahara |
| 2011/0050790 | A1 | 3/2011 | Irita |

* cited by examiner

INK JET RECORDING APPARATUS AND INK JET RECORDING METHOD

CROSS-REFERENCE TO RELATED APPLICATIONS

Cross Reference

This application is a continuation of U.S. patent application Ser. No. 14/679,312 filed Apr. 6, 2015, which is a continuation of U.S. patent application Ser. No. 14/073,121 filed Nov. 6, 2013, now U.S. Pat. No. 9,028,057 issued May 12, 2015, which is a continuation of U.S. patent application Ser. No. 13/074,441 filed on Mar. 29, 2011, now U.S. Pat. No. 8,602,548 issued Dec. 10, 2013, which claims priority to Japanese Patent Application No. 2010-077936 filed on Mar. 30, 2010 and Japanese Patent Application No. 2010-285957 filed on Dec. 22, 2010, all of which are hereby expressly incorporated by reference herein in their entireties.

BACKGROUND

1. Technical Field

The invention relates to an ink jet recording apparatus and an ink jet recording method.

2. Related Art

Recently, a photo-curable ink composition which is cured by light such as UV light or electron beams has been developed. The photo-curable ink composition generally includes a polymerizable compound, a polymerization initiator, a pigment, and other additive agents or the like. In addition, generally, in the case where an image is formed by using a photo-curable ink composition, after the photo-curable ink composition is applied to a recording medium by using, for example, an ink jet recording apparatus, the photo-curable ink composition is illuminated with light by using an appropriate light source and cured.

For example, JP-A-2004-216681 discloses an image forming method where activation ray curing type ink is illuminated with activation rays by two or more illumination units. It is disclosed in JP-A-2004-216681 that the ink curing ratio is set to be in the range of 6 to 70% by using a first activation ray, and after the entire printing is ended, the ink is completely cured through sufficient illumination of the activation ray, so that it is possible to form a high-definition image.

However, in some cases, the photo-curable ink composition is used for recording on a non-absorbable recording medium such as plastic, glass, or coated paper which does not or almost not absorb ink. In such recording, the photo-curable ink composition is applied on a non-absorbable recording medium and remains with the shape of liquid droplets for a certain period without permeation into the recording media. In addition, in the case where applied liquid droplets have fluidity, for example, adjacent liquid droplets may be combined to cause color bleeding, or liquid droplets may wet and spread to cause deterioration of definition of the image.

In addition, on the contrary, if the curing ratio is increased by, for example, fully illuminating the photo-curable ink composition with light immediately after the photo-curable ink composition is applied to the non-absorbable recording medium, since the liquid droplets do not have sufficient fluidity, the image may be formed in the state where the shape of the applied liquid droplets is maintained. In this case, for example, the wetting and spreading of the liquid droplets may be insufficient, the line width may be insufficient, and the glossiness or texture of the image may be deteriorated.

In the case where an image is formed on the non-absorbable recording medium by using the photo-curable ink composition in this manner, it is relatively difficult to form a desired image. For example, as disclosed in the aforementioned JP-A-2004-216681, in the method where the curing ratio is simply set to be in the range of 6 to 70% before the ink is completely cured, the fluidity of the liquid droplets is decreased and thus a high-definition image may be obtained. However, there is a problem in that, since the fluidity is insufficient, the line width may be insufficient, or the glossiness or the texture may not necessarily be good.

SUMMARY

An advantage of some aspects of the invention is to provide an ink jet recording apparatus capable of forming an image having small color bleeding and excellent definition and glossiness on a recording medium by using a photo-curable ink composition and a recording method using the apparatus.

The invention is contrived in order to solve at least a part of the aforementioned problems, and the invention may be implemented as the following aspects or applications.

Application 1

According to an aspect of the invention, there is provided an ink jet recording apparatus including: a head which applies liquid droplets on a recording medium by being relatively scanned with respect to the recording medium in a first direction and by ejecting the liquid droplets of a photo-curable ink composition from nozzle holes; and a first light source and a second light source which are sequentially disposed along the first direction at a downstream side in a scanning direction of the head to illuminate the liquid droplets applied to the recording medium with light, wherein after one second or less elapses from the time when the liquid droplets are applied to the recording medium, the liquid droplets are illuminated with light of the first light source, and wherein after 0.1 second or more and one second or less elapses from the time when the liquid droplets are illuminated with light of the first light source, the liquid droplets are illuminated with light of the second light source, so that the photo-curable ink composition is cured to have a curing ratio of 1% or more and 30% or less by the light of the first light source, and the photo-curable ink composition is cured to have a curing ratio of more than 30% and 80% or less by the light of the second light source.

According to the ink jet recording apparatus of the Application, the first light source and the second light source are provided, so that two-step preliminary curing may be performed on the photo-curable ink composition before the main curing. Therefore, it is possible to easily control the color bleeding, the definition, and the glossiness of the image formed on the recording medium. Accordingly, it is possible to form an image having small color bleeding and good definition and glossiness on the recording medium by using, for example, a photo-curable ink composition.

In addition, in the ink jet recording apparatus of the Application, the time elapsed before the liquid droplets are illuminated with the light of the first light source may be shorter than the time elapsed between the illumination of the light of the first light source and the light of the second light source. In this case, the liquid droplets of time photo-curable ink composition are illuminated with light from the second light source after a sufficient time elapses from the time when the liquid droplets are illuminated with light from the first light source. Therefore, it is possible to obtain more smooth surface of the liquid droplets applied to the recording medium, and it is possible to form an image having better glossiness on the recording medium.

Application 2

In Application 1, the first light source and the second light source may be light sources having an emission wavelength of which the peak wavelength is in the range of 365 nm or more to 410 nm or less.

According to the ink jet recording apparatus of the Application, since the first light source and the second light source may be small and have a low weight, for example, it is possible to increase a degree of freedom in the layout.

Application 3

In Application 1 or 2, after the illumination of the first light source and the second light source, the liquid droplets applied to the recording medium may further be illuminated with light, so that the curing ratio of the photo-curable ink composition is more than 80%.

According to the ink jet recording apparatus of the Application, two-step pinning may be performed by the first light source and the second light source, and the main curing may be further performed after that.

Application 4

In Application 3, the ink jet recording apparatus may further include a third light source which further illuminates the liquid droplets applied to the recording medium with light after the illumination of the first light source and the second light source.

According to the ink jet recording apparatus of the Application, the main curing may be performed by the light of the third light source, so that it is possible to sufficiently cure the photo-curable ink composition.

Application 5

In any one of Applications 1 to 4, the head may have a plurality of nozzle holes, and the nozzle holes may be disposed in the first direction.

Application 6

In any one of Applications 1 to 5, a relative scanning speed of the head with respect to the recording medium in the first direction may be in the range of 1 m/minute or more to 50 m/minute or less.

Application 7

According to another aspect of the invention, there is provided is an ink jet recording method including: applying liquid droplets on a recording medium by relatively scanning a head with respect to the recording medium in a first direction and by ejecting the liquid droplets of a photo-curable ink composition from nozzle holes of the head; illuminating the liquid droplets applied to the recording medium in the first direction with light by a first light source and a second light source which are sequentially disposed at a downstream side in a scanning direction of the head; illuminating the liquid droplets with light of the first light source after one second or less elapses from the time when the liquid droplets are applied to the recording medium; and illuminating the liquid droplets with light of the second light source after 0.1 second or more and one second or less elapses from the time when the liquid droplets are illuminated with light of the first light source, wherein the photo-curable ink composition is cured to have a curing ratio of 1% or more and 30% or less by the light of the first light source, and the photo-curable ink composition is cured to have a curing ratio of more than 30% and 80% or less by the light of the second light source.

According to the ink jet recording method of the Application, before the main curing of the photo-curable ink composition is performed, two-step preliminary curing, that is, the preliminary curing by the first light source and the preliminary curing by the second light source are performed. In addition, the photo-curable ink composition is illuminated with light so that the curing ratio according to the preliminary curing by the first light source is in the range of 1% or more to 30% or less and the curing ratio according to the preliminary curing by the second light source is in the range of more than 30% to 80% or less. Accordingly, it is possible to form an image having high definition and good glossiness while reducing color bleeding of the image formed by the photo-curable ink composition.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described. In addition, the embodiments described hereinafter are examples of the invention. Therefore, the invention is not limited to the embodiments described hereinafter, but various modified examples which are embodied within a range without changing the spirit of the invention may be included in the invention. In addition, all the configurations described hereinafter in the embodiments may not be necessary components of the invention.

1. Ink Jet Recording Apparatus

Figure 1:
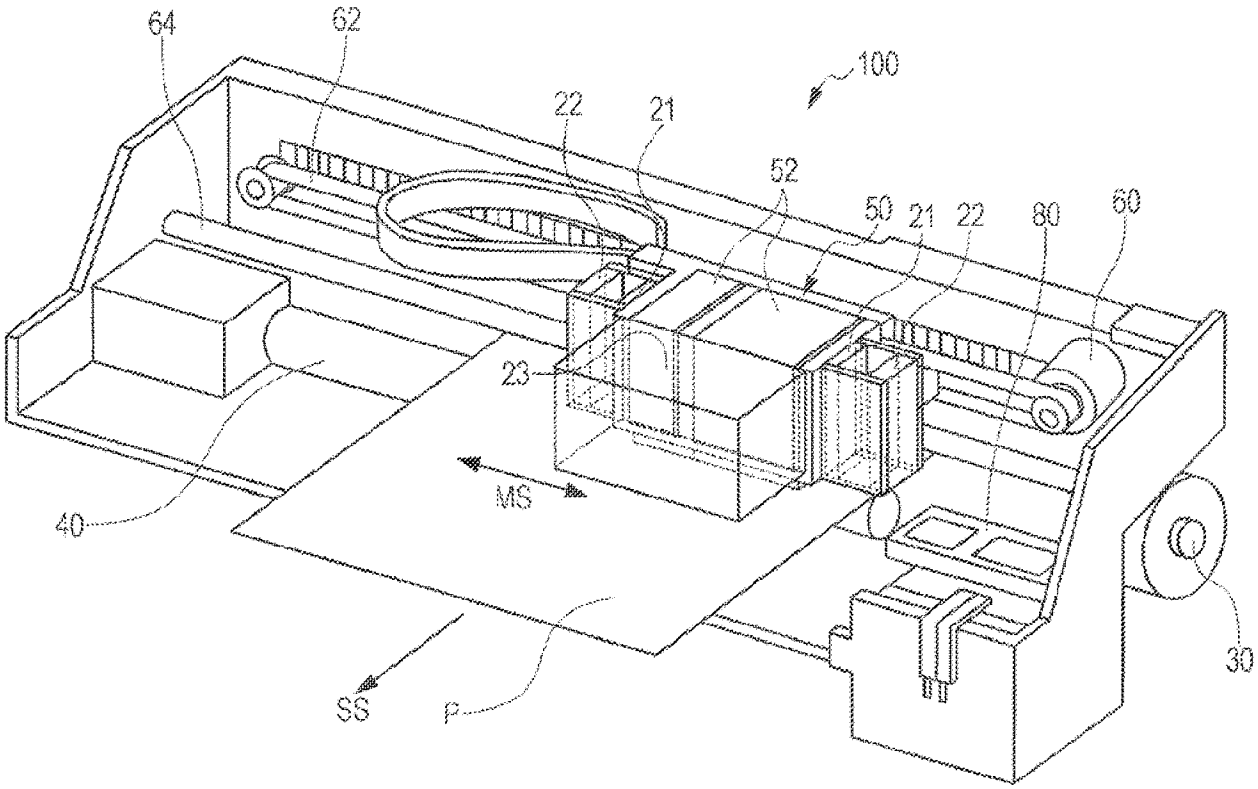
FIG. 1 is a schematic perspective view illustrating an ink jet recording apparatus.
Figure 2:
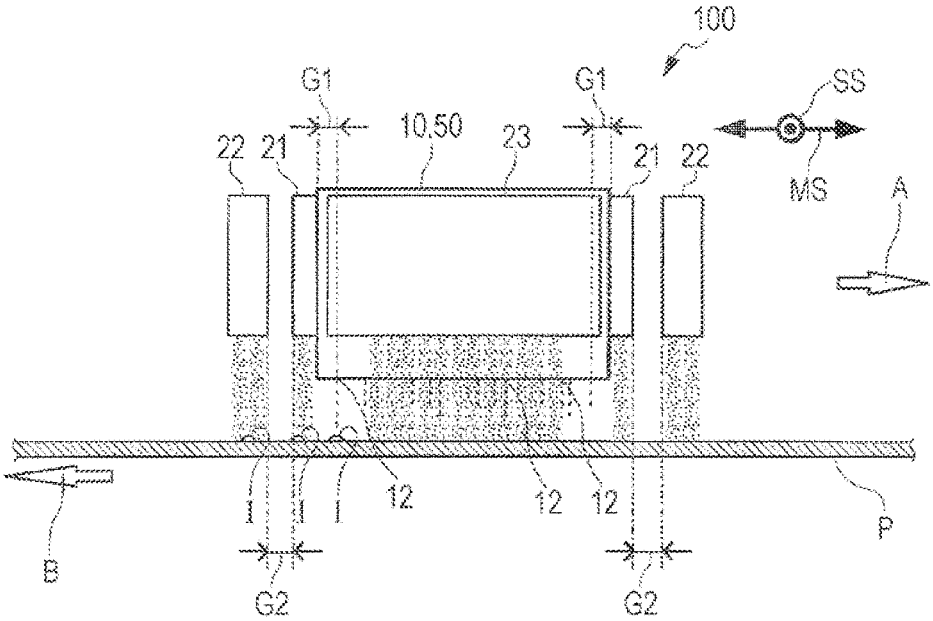
FIG. 2 is a schematic view illustrating a side surface of a head and a light source of the ink jet recording apparatus.
Figure 3:
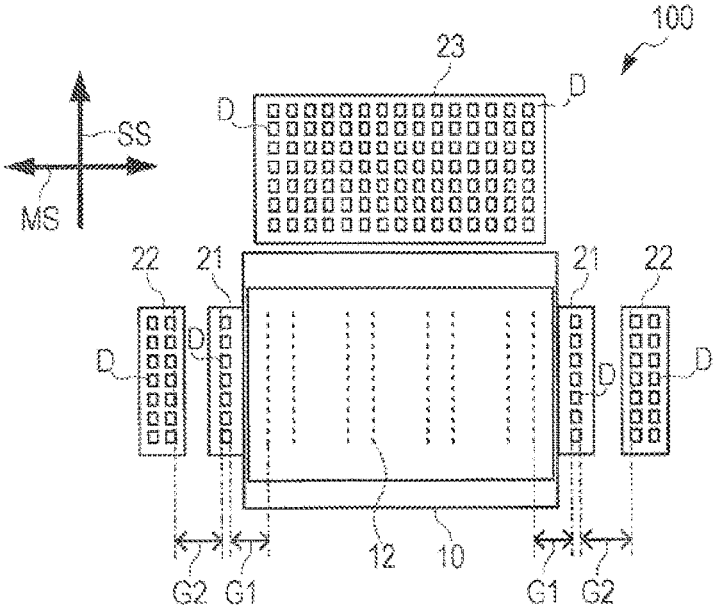
FIG. 3 is a schematic view illustrating a bottom surface of the head and the light source of the ink jet recording apparatus.

FIG. 1 is a schematic perspective view illustrating an ink jet recording apparatus 100 as an ink jet recording apparatus according to an embodiment of the invention. FIG. 2 is a schematic view illustrating a side surface of a head 10, a first light source 21, a second light source 22, and a third light source 23. FIG. 3 is a schematic view illustrating a bottom surface of the head 10, the first light source 21, the second light source 22, and the third light source 23. In addition, in each figure, a recording medium P is illustrated.

The ink jet recording apparatus 100 according to the embodiment includes the ink jet recording head 10, the first light source 21, and the second light source 22.

1.1. Ink Jet Recording Head

The ink jet recording head 10 according to the embodiment is allowed to be relatively scanned with respect to the recording medium P and to apply liquid droplets on the recording medium P by ejecting the liquid droplets of the photo-curable ink composition from nozzle holes 12. In the specification, the ink jet recording head 10 may be simply referred to as the head 10.

The phrase "the head being relatively scanned with respect to the recording medium" includes a configuration where any one of the head and the recording medium is moved so that the relative positional relationship therebetween is changed and a configuration where both of the head and the recording medium are moved so that the relative positional relationship therebetween is changed.

The method of ejecting liquid droplet by the head 10 may be selectable. The recording method of the head 10 includes, for example, a method of performing recording by applying a strong electric field between nozzles and acceleration electrode disposed in front of the nozzles to continuously eject ink in a shape of liquid droplets from the nozzles and by supplying a printing information signal to a polarization electrode during the time when the ink droplets exist between deflection electrodes or a method of spraying ink droplets in correspondence with a printing information signal without deflection (electrostatic suction method), a method of forcibly spraying ink droplets by applying a pressure to an ink solution by using a pump in small size and mechanically vibrating nozzles by using a quartz oscillator or the like, a method of spraying and recording ink droplets by simultaneously applying a pressure and a printing information signal to an ink solution by using a piezoelectric device (piezo method), a method of spraying and recording ink droplets by heating and foaming an ink solution by using a micro-electrode according to a printing information signal (thermal jet method), and the like.

Among them, the piezo method may be further classified into a method including a thin film type ink jet recording head and a method including a laminated type ink jet recording head. The thin film type ink jet recording head includes a so-called unimorph type piezoelectric actuator, so that an ink composition is ejected from the nozzles by displacement of the piezoelectric actuator. On the other hand, in the laminated type ink jet recording head, the ink droplets are ejected from the nozzles by pressing a wall of a pressure chamber communicated with the nozzles by driving a laminated type piezoelectric device in a d31 mode (a piezo mode). The latter ink jet recording head is also referred to as a longitudinal mode ink jet recording head in the point that the piezoelectric device is allowed to press the wall of the pressure chamber.

Although any type of the ink jet recording heads may be used as the head 10 according to the embodiment, the longitudinal mode type may be used because a relatively large ejection output of the photo-curable ink composition is obtained and it is possible to form a high-quality image, of which the shift in the printing position or the influence of satellites are small, at a high speed. On the other hand, in the case of using the thin film type ink jet recording head, the configuration is relatively small-sized and light-weighted. Accordingly, in the case where the position of the head 10 is moved (serial type) similarly to the ink jet recording apparatus 100 according to the embodiment, the high-speed operation may be performed, so that it is possible to form an image having a high quality and a high definition at a high speed.

The recording medium P used in the ink jet recording apparatus 100 according to the embodiment is not particularly limited as long as light for curing liquid droplets may reach the liquid droplets when the liquid droplets of the photo-curable ink composition are applied on the recording medium P. The recording medium P preferably has a printing surface where the ink droplets are not absorbed or almost not absorbed. As the recording medium P having such a printing surface, there is, for example, a non-absorbable recording medium of metal, glass, plastic, or the like. In addition, the recording medium P may be a colorless transparent medium, a semitransparent medium, a colored transparent medium, a colored non-transparent medium, an achromatic color non-transparent medium, or the like. In addition, the recording medium P may be any one of a glossy surface medium, a matt surface medium, and dull surface medium. As such a recording medium P, there are, for example, surface-treated paper such as coated paper, art paper, and cast-coated paper, a plastic film such as a vinyl chloride sheet or a polyethylene terephthalate (PET) film, and the like. As a commercialized recording medium, there are a glossy vinyl chloride sheet (for example, SP-SG-1270C (product name): manufactured by Roland DG Corp.), a PET film (for example, XEROX FILM <frameless> (product name): manufactured by Fuji Xerox Co., Ltd.), and the like.

The operation where the head 10 is relatively scanned in the first direction denotes that at least one of the head 10 and the recording medium P is moved so that the positional relationship therebetween is changed in the first direction.

For example, in the serial-type ink jet recording apparatus 100 illustrated in FIG. 1, the head 10 is moved in the scanning direction MS by the operation of the carriage 50. In other words, in the serial-type ink jet recording apparatus 100, the scanning direction MS becomes the first direction. Due to the operation, the head 10 is moved in the first direction, so that the photo-curable ink composition may be applied at different positions on the recording medium P.

In addition, the downstream side in the scanning direction of the head 10 denotes the opposite side in the relative scanning direction of the head 10 with respect to the recording medium P. In the case where liquid droplets are ejected from the head 10 in the scanning, the liquid droplets ejected from the head 10 are applied to the recording medium P located at the downstream side in the scanning direction. In addition, in the case where only the recording medium P is moved, the downstream side in the scanning direction of the head 10 denotes the opposite side in the relative scanning direction of the head 10 with respect to the recording medium P. In addition, in the aspect where the relative scanning direction of the head 10 with respect to the recording medium P is changed (for example, the aspect where the head 10 is reciprocatingly moved along the first direction), the downstream side in the scanning direction of the head 10 is defined in accordance with the change of the scanning direction of the head 10.

The relative scanning speed of the head with respect to the recording medium P is not particularly limited, but it may be set to, for example, be in the range of 1 m/minute or more to 50 m/minute or less. Accordingly, it is possible to record an image at high speed.

The nozzle holes 12 are formed on a surface of the head facing the recording medium P. The head 10 may eject liquid droplets of the photo-curable ink composition from the nozzle holes 12. The number and layout of the nozzle holes 12 are not particularly limited. In the example illustrated in FIG. 3, in the head 10 of the serial-type ink jet recording apparatus 100, the nozzle holes 12 are disposed in array in the direction (the direction along the scanning direction SS) intersecting the movement direction of the carriage 50, and eight rows are formed in parallel along the scanning direction MS of the carriage 50.

1.2. Light Source 1.2.1. First Light Source

Similarly to the aforementioned head 10, the first light source 21 is relatively scanned with respect to the recording medium P. Since the details of the relative scanning of the first light source 21 are the same as those of the scanning of the head 10 described above, the description thereof is omitted.

The first light source 21 is moved together with the aforementioned head 10, and the first light source 21 is disposed at least at one end in the movement direction of the head 10. In the example of FIGS. 1 to 3, the first light source 21 is mounted on the carriage 50 together with the head 10. In the serial-type ink jet recording apparatus 100, it is preferable that the first light source 21 be disposed at both ends in the scanning direction (arrow MS in the figure) of the head 10.

The shape of the first light source 21 is not particularly limited, but a shape capable of illuminating liquid droplets of the photo-curable ink composition ejected from the nozzle holes 12 of the head 10 with light by scanning the carriage 50 one time is preferred. For example, in the example of FIG. 3, the shape of the first light source 21 is determined so that the nozzle holes 12 of the head 10 have a trajectory including the trajectory drawn by the illumination area of light from the first light source 21 at the time of scanning the carriage 50. In addition, the length of the first light source 21 in the scanning direction and the distance between the first light source 21 and the recording medium P may be selectable on the basis of an intensity of illumination light, an illumination time interval, and the like.

As the light emitted from the first light source 21, there are, for example, electromagnetic waves from 200 nm to 410 nm such as UV light, visible light, FUV (far ultraviolet) ray, g-ray, h-ray, i-ray, KrF excimer laser light, ArF excimer laser light, or X ray. The light generating unit of the first light source 21 is not particularly limited. As a specific form of the first light source 21, light of, for example, a metal halide lamp, a xenon lamp, a carbon arc lamp, a chemical lamp, a low pressure mercury lamp, a high pressure mercury lamp, an H lamp, a D lamp, a V lamp (available from Fusion System Company, for example) or the like may be introduced through an optical guide, an optical fiber, or the like to the first light source 21. In addition, as another specific form of the first light source 21, for example, a light emitting device such as a UV light emitting diode (UV LED) or a UV light emitting semiconductor laser may be employed. In the case where the light generating unit of the first light source 21 is a light emitting device, for example, the emission wavelength may be in the range of 365 nm or more to 410 nm or less. If such wavelength is selected, a photo polymerization initiator in the photo-curable ink composition may be easily selected. In addition, if such light emitting device is selected as the light generating unit of the first light source 21, it is possible to implement the first light source 21 having a small size and a low weight and to increase a degree of freedom in the layout of the first light source 21. For example, in the example of FIGS. 2 and 3, the first light source 21 has a configuration where a plurality of UV light emitting diodes (UV LEDs) (symbol D) are disposed along the array of the nozzle holes 12.

The first light source 21 may illuminate liquid droplets of the photo-curable ink composition applied to the recording medium P with light. The first light source 21 may be configured to continuously emit light or to blink or increase or decrease the light. The first light source 21 is disposed at the position where the liquid droplets of the photo-curable ink composition are illuminated with light emitted from the first light source 21 in a time interval of 0.001 seconds or more to one second or less from the time when the liquid droplets of the photo-curable ink composition are ejected and applied to the recording medium P. In other words, the first light source is disposed above the recording medium P at the position which is separated by a first distance G1 from the nozzle hole 12 nearest to the first light source 21. In the case where the liquid droplets are illuminated with light by the first light source 21 after more than one second elapse from the time when the liquid droplets are applied, bleeding may be deteriorated.

In addition, in the case where the head 10 includes a plurality of the nozzle holes 12 (an array of the nozzle holes 12) in the first direction (direction indicated by MS in the illustrated example) as illustrated in FIGS. 2 and 3, it is preferable that each liquid droplet ejected from each nozzle hole 12 and applied to the recording medium P be illuminated with light emitted from the first light source 21 in the time interval of one second or less from the time when the liquid droplet is applied. Particularly, among the liquid droplets ejected from a plurality of the nozzles aligned in the first direction, with respect to the liquid droplets illuminated with light emitted from the first light source 21 in the time interval of 0.001 seconds or more to 1 second or less from the time when the liquid droplets are applied, it is possible to obtain a good image quality.

Herein, the position where the first light source 21 is disposed is changed depending on the scanning speed of the carriage 50 or the recording medium P. For example, if the first distance G1 between the nozzle hole 12 nearest to the first light source 21 and the light generating portion of the first light source 21 is 10 mm, in the case where the scanning speed of the carriage 50 is set to 10 m/minute, after 0.06 seconds elapses from the time when liquid droplets are ejected from the nozzle hole 12 and applied to the recording medium P, the liquid droplets are illuminated with light emitted from the first light source 21. At this time, if the distance in the first direction between the nozzle hole 12 nearest to the first light source 21 and the nozzle hole 12 farthest from the first light source 21 is 30 mm, after 0.24 seconds elapses from the time when liquid droplets ejected from the farthest nozzle hole 12 land the recording medium P, the liquid droplets are illuminated with light emitted from the first light source 21. Similarly, for example, if the first distance G1 between the nozzle hole 12 nearest to the first light source 21 and the light generating portion of the first light source 21 is 140 mm, in the case where the scanning speed of the carriage 50 is set to 20 m/minute, after 0.42 seconds elapses from the time when liquid droplets are ejected from the nozzle hole 12 and applied to the recording medium P, the liquid droplets are illuminated with light emitted from the first light source 21. At this time, after 0.51 seconds elapses from the time when liquid droplets ejected from the farthest nozzle hole 12 land the recording medium P, the liquid droplets are illuminated with light emitted from the first light source 21. In this manner, the distance between a plurality of the nozzle holes, the distance G1, and the scanning speed of the carriage are set so that liquid droplets ejected from a plurality of the nozzle holes 12 aligned in the first direction are illuminated with light emitted from the first light source 21 in the time interval of 0.001 seconds or more to 1 second or less.

The aforementioned values are exemplary ones. The actual dimensions of the ink jet recording apparatus 100 according to the embodiment are not limited as long as liquid droplets are illuminated with light emitted from the first light source 21 in the time interval of 1 second or less from the time when the liquid droplets are ejected from the nozzle holes 12 of the head 10 and applied to the recording medium P.

One of the functions of the first light source 21 is to cause the curing reaction of liquid droplets of the photo-curable ink composition applied to the recording medium P. In the case where the recording medium P has a non-absorption property, if the liquid droplets of the photo-curable ink composition are not yet cured, the wetting and spreading of the liquid droplets on the recording medium P may excessively occur, or the liquid droplets may be combined with other liquid droplets, causing unnecessary color bleeding. After applying liquid droplets, the liquid droplets are illuminated with light from the first light source 21 within the aforementioned time range, so that a portion of the photo-curable ink composition constituting the liquid droplets is cured. Therefore, it is possible to reduce unnecessary wetting and spreading of the liquid droplets on the recording medium P and unnecessary color bleeding due to combination with other liquid droplets. In the specification, this aspect of the light illumination may be referred to as "pinning" (temporary curing). In other words, as one of the functions of the first light source 21, there is the pinning of liquid droplets of the photo-curable ink composition.

A degree of pinning by the first light source 21 may be expressed by a conversion ratio (curing ratio) of the photo-curable ink composition in the liquid droplets, that is, a ratio of the cured composition to the entire liquid droplet composition. In the case where the degree of pinning by the first light source 21 is expressed by the conversion ratio (curing ratio), the degree of pinning is set to be in the range of 1% or more to less than 30%. The pinning by the first light source 21 is performed in order to reduce unnecessary wetting and spreading of the liquid droplets of the photo-curable ink composition or to reduce unnecessary color bleeding. However, it is not intended to prevent these phenomena completely. If the degree of pinning by the first light source 21 becomes 30% or more in the conversion ratio, the viscosity of the liquid droplet may be increased, so that necessary wetting and spreading or necessary color bleeding may not be obtained. In addition, since the shape of the liquid droplet is retained as the shape at the time of application, in some cases, undesirable influence may be exerted to, for example, the glossiness or texture of the formed image. The degree of pinning by the first light source 21 is preferably in the range of 1% or more to less than 10% in the conversion ratio, more preferably, in the range of 1% or more to less than 5% in the point that large dots are speedily formed. In the specification, the curing ratio and the conversion ratio are used as the same meaning.

In addition, the degree of pinning by the first light source 21 may be set to be in the aforementioned range by adjusting at least one of the light amount of the first light source 21, increase or decrease in the light amount, light blinking, size in the scanning direction, distance toward the recording medium P, amount of the photo polymerization initiator in the photo-curable ink composition, type of a colorant, and the like.

1.2.2. Second Light Source

Similarly to the aforementioned head 10, the second light source 22 is relatively scanned with respect to the recording medium P. Since the details of the relative scanning of the second light source 22 are the same as those of the scanning of the head 10 described above, the description thereof is omitted.

The second light source 22 and the first light source 21 are disposed as a set for the head 10. In other words, the second light source 22 is disposed at the position opposite the head 10 with respect to the first light source 21. In the example of FIGS. 1 to 3, the second light source 22 is mounted on the carriage 50 together with the head 10. In the serial-type ink jet recording apparatus 100 as illustrated in FIG. 1, it is preferable that the second light source 22 be disposed at the both ends in the scanning direction (arrow MS in the figure) of the head 10. In addition, the second light source 22 is disposed to be separated by a gap of the second distance G2 from the first light source 21.

The shape of the second light source 22 is not particularly limited, but a shape capable of illuminating liquid droplets of the photo-curable ink composition ejected from the nozzle holes 12 of the head 10 with light by scanning the carriage 50 one time is preferred. For example, in the example of FIG. 3, the shape of the second light source 22 is determined so that the nozzle holes 12 of the head 10 have a trajectory including the trajectory drawn by the illumination area of the light from the second light source 22 at the time of the scanning of the carriage 50. In addition, the length of the second light source 22 and the distance between the second light source 22 and the recording medium P may be selectable on the basis of an intensity of illumination light, an illumination time interval, and the like.

Since the light emitted from the second light source 22 is the same as that of the aforementioned first light source 21, the description thereof is omitted. In the example of FIGS. 2 and 3, the second light source 22 has a configuration where a plurality of UV light emitting diodes (UV LEDs) (symbol D) is arranged along the array of the nozzle holes 12. In addition, the configurations for generating light of the first light source 21 and light of the second light source 22 may be different from each other in terms of types and wavelengths.

The second light source 22 may illuminate liquid droplets of the photo-curable ink composition applied to the recording medium P with light. The second light source 22 may be configured to continuously emit light or to blink or increase or decrease light. The second light source 22 is disposed at the position where the liquid droplets of the photo-curable ink composition are illuminated with light emitted from the second light source 22 in a time interval of 0.1 seconds or more to 1 second or less from the time when the liquid droplets are illuminated with the light emitted from the first light source 21. In other words, the second light source is disposed at the position which is separated by a second distance G2 from the first light source 21 so that the light illumination area of the second light source on the recording medium P reaches the position of the liquid droplets where the light illumination of the first light source 21 on the recording medium P is ended in the time interval of 0.1 seconds or more to one second or less. At this time, with respect to the liquid droplets ejected from the nozzle holes 12 located at the position other than the position of the nozzle hole 12 nearest to the first light source 21 in the first direction, it is also preferable to be illuminated with the light from the second light source 22 in a time interval of 0.1 seconds or more to one second or less from the time when the light illumination from the first light source 21 is ended. In the case where the illumination is performed after more than 1 second elapses, the bleeding may be deteriorated. In the case where the illumination is performed in the time interval of less than 0.1 seconds, the line width or the glossiness may be deteriorated.

In addition, the position of the installation of the second light source 22 is changed depending on the scanning speed of the carriage 50 or the recording medium P. For example, if the distance to the light generating portion of the second light source 22 from the end of the light generating portion of the first light source 21 near the second light source 22 (the second distance G2) is 20 mm, in the case where the scanning speed of the carriage 50 is set to 10 m/minute, liquid droplets are illuminated with light emitted from the second light source 22 after 0.12 seconds from the time when the liquid droplets are illuminated with light of the first light source 21. At this time, with respect the liquid droplets ejected from any one of the plurality of the nozzle holes aligned in the first direction, the time from the time when the liquid droplets are illuminated with light of the first light source 21 to the time when the liquid droplets are illuminated with light emitted from the second light source 22 is the same. Similarly, for example, if the distance to the light generating portion of the second light source 22 from the light generating portion of the first light source 21 (the second distance G2) is 140 mm, in the case where the scanning speed of the carriage 50 is set to 20 m/minute, the liquid droplets are illuminated with light emitted from the second light source 22 after 0.42 seconds from the time when the liquid droplets are illuminated with light of the first light source 21. These values are exemplary ones. The actual dimensions of the ink jet recording apparatus 100 according to the embodiment are not limited as long as the liquid droplets of the photo-curable ink composition are illuminated with light emitted from the second light source 22 in the time interval of 0.1 seconds or more to 1 second or less from the time when the liquid droplets are illuminated with light of the first light source 21.

One of the functions of the second light source 22, is to cause the curing reaction of the liquid droplets of the photo-curable ink composition applied to the recording medium P. In the case where the recording medium P has a non-absorption property, if the liquid droplets of the photo-curable ink composition are not yet cured, the wetting and spreading of the liquid droplets on the recording medium P may excessively occur, or the liquid droplets may be combined with other liquid droplets, causing unnecessary color bleeding. In the ink jet recording apparatus 100 according to the embodiment, these phenomena are reduced by using the aforementioned first light source 21, so that the liquid droplets may be allowed to have an appropriate conversion ratio (viscosity of the liquid droplets) and the controlled wetting and spreading and color bleeding may occur in the time interval (0.1 seconds or more to 1 second or less) by the time when the liquid droplets are illuminated with the light of the second light source 22. Subsequently, a part of the photo-curable ink composition constituting the liquid droplets is further cured by the light of the second light source 22, so that the wetting and spreading of the liquid droplets on the recording medium P and the color bleeding due to combination with other liquid droplets are controlled. In other words, in the ink jet recording apparatus 100 according to the embodiment, the shape and the wetting and spreading of the liquid droplets and a degree of the color bleeding are controlled by the two-time pinning by the light of the first light source 21 and the light of the second light source 22.

The curing ratio of the pinning by the light illumination of the second light source 22 is set to be in the range of, for example, more than 30% to 80% or less in combination with the pinning by the light illumination of the first light source 21. If the degree of the pinning by the second light source 22 exceeds 80% in the conversion ratio, the viscosity of the liquid droplets is unnecessarily increased, so that necessary wetting and spreading and necessary color bleeding may not be obtained. In addition, if the degree of the pinning by the second light source 22 exceeds 80% in the conversion ratio, the shape of the liquid droplets is retained as the shape at the time of application, in some cases, undesirable influence may be exerted to, for example, the glossiness or texture of the formed image. The degree of the pinning by the second light source 22 is, for example, is preferably in the range of 40% or more to 80% or less in the conversion ratio, more preferably, in the range of 50% or more to 80% or less in the point that sufficient light width is secured.

In addition, the degree of the pinning by the second light source 22 may be set to be in the aforementioned range by adjusting at least one of the light amount of the second light source 22, increase or decrease in the light amount, light blinking, size in the scanning direction, distance toward the recording medium P, amount of the photo polymerization initiator in the photo-curable ink composition, type of a colorant, and the like.

In addition, as described above, although the first distance G1 and the second distance G2 are set so that the aforementioned time intervals may be implemented, the first distance G1 may be configured to be smaller than the second distance G2. In such cases, when the scanning speed of the carriage 50 or the recording medium P is constant, it is possible to control the wetting and spreading of the liquid droplets of the photo-curable ink composition applied to the recording medium P or the color bleeding by using light of the first light source 21, and it is possible to increase the time interval where the wetting and spreading and the color bleeding occurs in the controlled state. Therefore, it is possible to easily control a dot size of the liquid droplet or surface roughness.

In the case where the head 10 is scanned in the first direction, for example, rightwards in FIG. 2, the first light source 21 and the second light source 22 may be sequentially disposed on the left side (the downstream side in the scanning direction) of the head 10 in this order. In addition, in the case of performing one-directional printing where the liquid droplet ejection is performed when the head is scanned rightwards in FIG. 2 and the liquid droplet ejection is not performed when the head 10 is scanned leftwards, the first light source 21 and the second light source 22 may be disposed at least to the left side of the head 10. If the liquid droplet ejection is performed in the case where the head 10 is scanned rightwards in FIG. 2 as well as in the case where the head 10 is scanned leftwards, as illustrated in FIG. 2, the first light sources 21 and the second light sources 22 are disposed at the right and left sides of the head 10 (either of the right and left sides becomes the downstream side in the scanning direction of the head 10).

1.2.3. Third Light Source

The ink jet recording apparatus 100 according to the embodiment may further include a third light source 23 by which liquid droplets applied to the recording medium P are illuminated with light through relative scanning of the head 10 and the recording medium P.

The third light source 23 may be relatively scanned with respect to the recording medium P similarly to the aforementioned head 10. In addition, the third light source 23 may be disposed separately from the carriage 50 at the downstream side in the movement direction of the recording medium P, so that the illumination by the third light source may be performed after the scanning of the head 10. FIGS. 1 to 3 exemplarily illustrate an example where the third light source 23 is disposed to the carriage to be moved together with the head 10, so that the illumination by the third light source 23 is performed by the scanning after the scanning for the illumination by the first light source 21 and the second light source 22. Further, for example, two third light sources may be disposed at the positions separate from the second light sources 22 in the carriage on the side opposite the head 10 in the main scanning direction. The illumination by the third light source 23 may be performed after the illumination by the first light source 21 and the second light source 22 in the same scanning, similarly to the scanning for the illumination by the first light source 21 and the second light source 22. In addition, the ink jet recording apparatus 100 according to the embodiment may not include the third light source 23. In this case, if necessary, the photo-curable ink composition applied to the recording medium P and pinned by the first light source 21 and the second light source 22 may be cured by using another light illumination apparatus or the like. Alternatively, after the pinning for curing with a predetermined curing ratio is performed by the scanning for the illumination by the first light source 21 and the second light source 22, the carriage 50 is further moved, and the illumination by the first light source 21 and the second light source 22 may be further performed.

In the ink jet recording apparatus 100 according to the embodiment, the third light source 23 is disposed at the downstream side in the movement direction of the recording medium P with respect to the head 10 (the downstream side in the transport direction SS of the recording medium P intersecting the scanning direction MS of the head 10). In addition, in the embodiment, the third light source 23 together with the aforementioned head 10 is scanned in the first direction. Since the details of the scanning of the third light source 23 are the same as those of the scanning of the aforementioned head 10, the description thereof is omitted.

The shape of the third light source 23 is not particularly limited. The third light source 23 may illuminate liquid droplets with light so as to further cure the liquid droplets which are pinned by the first light source 21 and the second light source 22. In other words, the third light source 23 is disposed at the one end of the downstream side in the scanning direction of the recording medium P (the side where the light of the third light source is emitted after the photo-curable ink composition is applied to the recording medium P: the distal end of the arrow SS in the figure). According to the illustrated example, the third light source 23 is disposed along the end of the head 10 of the distal end of the arrow SS indicating the scanning direction SS of the recording medium P.

Since the light emitted from the third light source is the same as that of the aforementioned first light source 21, the description thereof is omitted. In the illustrated example, the third light source 23 has a configuration where a plurality of UV light emitting diodes (UV LEDs) (symbol D) are arrayed in a matrix shape.

The third light source 23 may illuminate the liquid droplets of the photo-curable ink composition applied to the recording medium P with light. The third light source 23 may be configured to continuously emit light or to blink or increase or decrease light. The size of the third light source 23 is not particularly limited. However, in the illustrated example, the size of the third light source 23 in the movement direction (scanning direction SS) of the recording medium P is preferably larger than a unit of moving distance of the recording medium P when the ink jet recording apparatus 100 is driven. Accordingly, it is possible to illuminate securely the liquid droplets of the photo-curable ink composition with light of the third light source 23. In addition, the size of the third light source 23 in the movement direction (scanning direction MS) is not also limited, but it may be designed according to the size of the casing of the apparatus or the like.

One of the functions of the third light source 23 is to cause the curing reaction of liquid droplets of the photo-curable ink composition applied to the recording medium P. In the case where the recording medium P has a non-absorption property, the liquid droplets of the photo-curable ink composition are subjected to the two-step pinning by the light of the aforementioned first light source 21 and the aforementioned second light source 22, and after that, the sufficient curing (main curing) of the photo-curable ink composition by the light of the third light source 23 is performed.

In the ink jet recording apparatus 100 according to the embodiment, light of the third light source 23 reaches the liquid droplets through the scanning of the recording medium P. In other words, the liquid droplets are ejected from the head 10 and applied to the recording medium P, and after that, the liquid droplets are subjected to at least two times of pinning by the light of the first light source 21 and the second light source 22. After that, the recording medium P is moved in the scanning direction SS, and the head 10 (carriage 50) is moved in the scanning direction MS of the head 10. When the head 10 reaches the position of the liquid droplets, the liquid droplets are illuminated with light of the third light source 23. In addition, although the illumination depends on the transport amount of the recording medium P in the scanning direction SS, the liquid droplets at the position are illuminated with light of the third light source 23 several times. Therefore, in this case, the pinned liquid droplets are illuminated intermittently with light of the third light source 23 several times.

In the ink jet recording apparatus 100 according to the embodiment, the pinned liquid droplets of the photo-curable ink composition are illuminated intermittently with light of the third light source 23. Therefore, the curing reaction of the liquid droplets after the pinning proceeds more smoothly, so that it is possible to obtain an advantage in that, for example, a dot surface becomes smoother and contraction caused by the curing is alleviated.

A degree of the curing after the light illumination by the third light source 23 is set to be preferably, for example, in the range of more than 80% to 100% or less as the sum of the curing ratios by the light of the first light source 21 to the third light source 23. If the degree of the curing (main curing) by the third light source 23 is more than 80% as the conversion ratio, sufficient curing may be obtained. However, the degree of the curing by the third light source 23 is preferably 90% or more.

1.3. Other Configurations

The ink jet recording apparatus 100 according to the embodiment may have the following configurations.

In the ink jet recording apparatus 100 exemplified as the embodiment, as described above, the head 10 is a serial-type head of ejecting three or more colors for full color printing, and a plurality of the nozzle holes 12 are provided for each color. In addition to the head 10, a plurality of cartridges 52 as ink containers for containing various types of photo-curable ink composition which is to be supplied to the head 10 are mounted on the carriage 50 where the head 10 is mounted. The ink contained in each of the cartridges 52 is the later-described photo-curable ink composition. In addition, one color or two colors or more of the photo-curable ink composition may be ejected from the head 10.

In addition, the ink jet recording apparatus 100 illustrated in FIG. 1 includes a motor 30 which transports the recording medium P in the scanning direction SS, a platen 40, the carriage 50 on which the head 10 is mounted, and a carriage motor 60 which moves the carriage 50 in the scanning direction MS.

The carriage 50 is pulled by a pulling belt 62 driven by the carriage motor 60 so as to be moved along a guide rail 64. The head 10 is mounted on the carriage 50, so that the head 10 is moved in the scanning direction MS along with the movement of the carriage 50 in the scanning direction MS.

In addition, in the illustrated ink jet recording apparatus 100, a capping unit 80 for sealing a surface where the nozzle holes 12 of the head 10 are formed at the time of stop is disposed at a home position (the right side position of FIG. 1) of the carriage 50. When the printing is ended, the carriage 50 reaches the position above the capping unit 80. At this time, the capping unit 80 is automatically lifted up by a mechanism (not shown), so that the surface where the nozzle holes 12 of the head 10 are formed may be sealed.

1.4. Modified Example

Hereinafter, as a modified example of the ink jet recording apparatus according to the embodiment, an ink jet recording apparatus 200 (so-called a line-type ink jet recording apparatus) of a type where a head 210 is relatively scanned with respect to a recording medium P by changing a positional relationship between the head 210 and the recording medium P by fixing the head 210 and moving the recording medium P is described.

Figure 4:
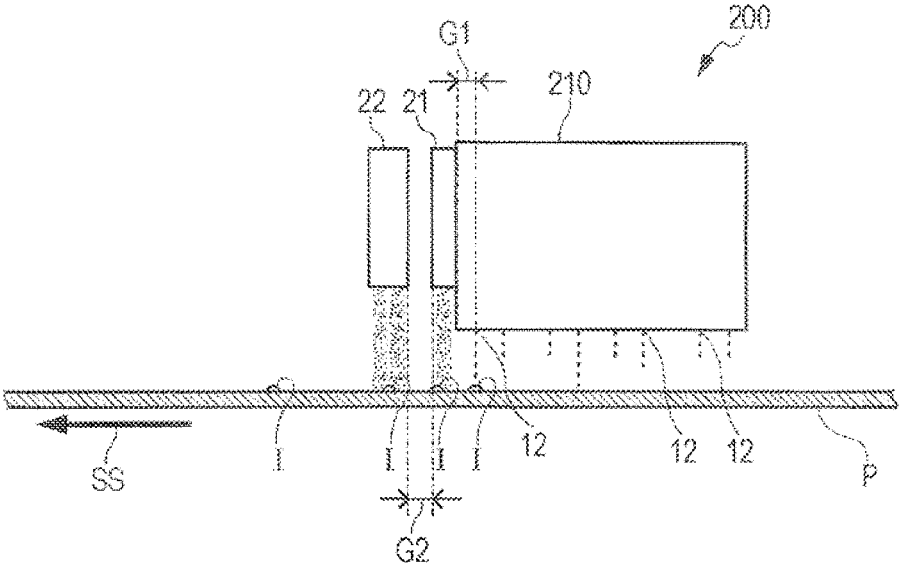
FIG. 4 is a schematic view illustrating a side surface of the head and the light source of the ink jet recording apparatus.
Figure 5:
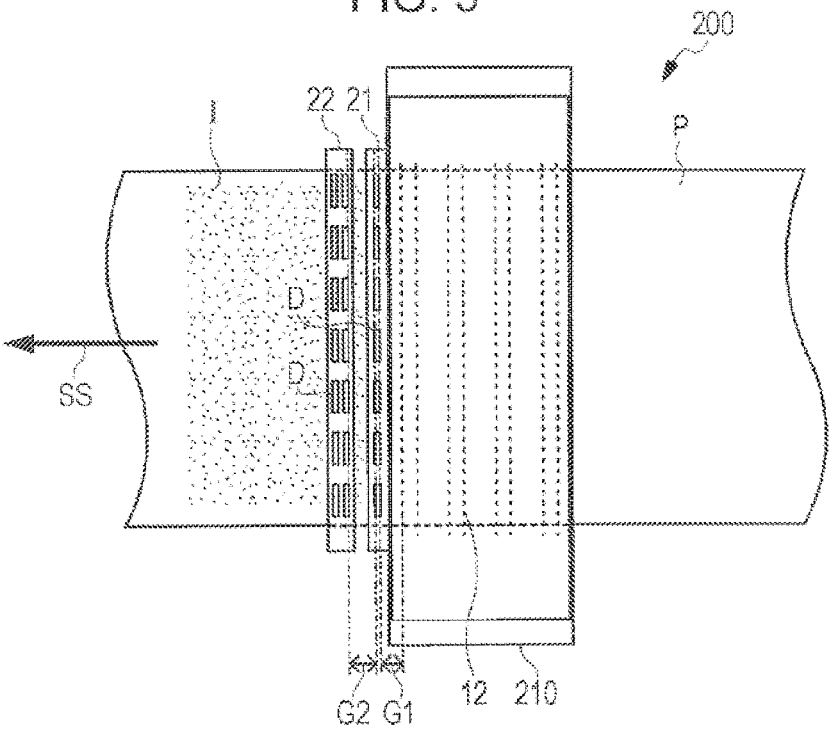
FIG. 5 is a schematic view illustrating a top surface of the head and the light source of the ink jet recording apparatus.

FIG. 4 is a schematic view illustrating a side surface of the head 210, the first light source 21, and the second light source 22 of the line-type ink jet recording apparatus 200. FIG. 5 is a schematic view illustrating a top surface of the head 210, the first light source 21, and the second light source 22 of the line-type ink jet recording apparatus 200. In addition, in these figures, the recording medium P is illustrated.

As illustrated in FIGS. 4 and 5, in the ink jet recording apparatus 200 of the modified example, the movement direction of (scanning direction SS) of the recording medium P is the first direction. In this case, according to the transporting of the recording medium P, the positional relationship between the head 210 and the recording medium P is changed in the first direction. Therefore, the photo-curable ink composition may be applied at different positions on the recording medium P.

In addition, in the line-type ink jet recording apparatus 200, the first light source 21 and the second light source 22 are disposed at the end of the downstream side (the side where the liquid droplets applied by the head 210 are illuminated with light from the first light source 21 and the second light source 22) in the movement direction (the first direction) of the recording medium P.

As illustrated in FIGS. 4 and 5, in the line-type ink jet recording apparatus 200, as the layout of the nozzle holes 12 in the head 210, the layout where the nozzle holes are disposed in array in the direction (the direction along the scanning direction MS) intersecting the movement direction of the recording medium P and a plurality of rows are formed in parallel in the scanning direction SS of the recording medium P may be exemplified.

In addition, since the line-type ink jet recording apparatus 200 is substantially the same as the serial-type ink jet recording apparatus 100 according to the aforementioned embodiment except that the positional relationship between the head 210 and the recording medium P is changed in the first direction by the movement of the recording medium P, the description thereof is omitted.

In addition, in the embodiment and the modified examples, although the configuration where a plurality of nozzle rows are disposed in the head is exemplified, a single nozzle array may be disposed in the head. In the example where a single nozzle array is disposed in the head, monochrome recording may be performed. However, the ink jet recording apparatus according to the invention may be an ink jet recording apparatus which includes a plurality of sets, each of which includes a single-color head, a first light source, and a second light source, so at to record a multicolored image. A line-type ink jet recording apparatus of FIG. 4 may include a third light source that further performs illumination of light after the light illumination of the first light source and the second light source. The third light source may be disposed at the downstream side in the transport direction of the recording medium from the second light source.

1.5. Photo-Curable Ink Composition

As a photo-curable ink composition ejected from the head 10 of the ink jet recording apparatus 100 according to the embodiment, there is, for example, at least a material containing a polymerizable compound and a photo polymerization initiator.

1.5.1. Polymerizable Compound

The photo-curable ink composition according to the embodiment contains a polymerizable compound. As the polymerizable compound, there is a material having at least one of a photo cationic polymerization property and a photo radical polymerization property. The polymerizable compound contained in the photo-curable ink composition may have a photo cationic polymerizable functional group and a photo radical polymerizable functional group in one molecule. The polymerizable compound include a monomer, a dimer, a molecule having several unit molecules, and an oligomer having a molecular weight of about several tens of hundred. The containing amount is adjusted so that the compound is in the viscosity range where it may be used as the ink for ink jet.

As a group having a photo radical polymerization property, there are groups having a photo radical polymerizable unsaturated double bond. For example, there are an acryloyl group, a methacryloyl group, an acrylamide group, a methacrylamide group, an allyl group, a vinyl ether group, a vinyl thioether group, a vinyl amino group, and a vinyl group. In terms of a particularly high photo radical polymerization property, preferably, there are an acryloyl group, an acrylamide group, a methacryloyl group, and a methacrylamide group, and more preferably, there are an acryloyl group and an acrylamide group.

As a specific example of a monomer of the photo radical polymerizable compound, there are an unsaturated carboxylic acid such as an acryl acid, a methacryl acid, an itaconic acid, a fumaric acid, and a maleic acid and an ester series thereof, a styrene derivative such as styrene, vinyl toluene, and dimethyl styrene, an N-vinyl compound such as N-vinyl pyrrolidone, N-vinyl caprolactam, N-vinyl formamide, and N-vinyl acetamide, N-substituted maleimide, acrylonitrile, acryloyl morpholine, and the like.

As a specific example of an oligomer of the photo radical polymerizable compound, there are polyester acrylate, polyurethane acrylate, epoxy acrylate, polyether acrylate, oligo acrylate, alkyd acrylate, polyol acrylate, polyester methacrylate, polyurethane methacrylate, epoxy methacrylate, polyether methacrylate, oligo methacrylate, alkyd methacrylate, polyol methacrylate, and the like.

Among them, as a polymerizable compound according to the embodiment, the acrylic ester series having an acryloyl group, an N-vinyl compound, and acryloyl morpholine are preferable in terms of an excellent photo polymerization property.

In addition, as a specific example of the polymerizable compound, there are a (meth)acrylate series, a (meth)acrylamide series, an N-vinyl compound, and the like.

As a mono-functional (meth)acrylate, there are hexyl (meth)acrylate, 2-ethyl hexyl(meth)acrylate, tert-octyl (meth)acrylate, isoamyl(meth)acrylate, decyl(meth)acrylate, isodecyl(meth)acrylate, stearyl(meth)acrylate, iso stearyl (meth)acrylate, cyclo hexyl(meth)acrylate, 4-n-butyl cyclohexyl(meth)acrylate, bornyl(meth)acrylate, isobornyl(meth) acrylate, benzil(meth)acrylate, 2-ethyl hexyldiglycol(meth) acrylate, butoxyethyl(meth)acrylate, 2-chloroethyl(meth) acrylate, 4-bromobutyl(meth)acrylate, cyanoethyl(meth) acrylate, benzil(meth)acrylate, butoxy methyl(meth) acrylate, 3-methoxy butyl(meth)acrylate, alkoxy methyl (meth)acrylate, alkoxyethyl(meth)acrylate, 2-(2-methoxy ethoxy)ethyl(meth)acrylate, 2-(2-butoxy ethoxy)ethyl (meth)acrylate, 2,2,2-tetrafluoroethyl(meth)acrylate, 1H,1H, 2H,2H-perfluorodecyl(meth)acrylate, 4-butyl phenyl(meth) acrylate, phenyl(meth)acrylate, 2,4,5-tetramethyl phenyl (meth)acrylate, 4-chlorophenyl(meth)acrylate, phenoxy methyl(meth)acrylate, phenoxyethyl(meth)acrylate, glycidyl(meth)acrylate, glycidyloxy butyl(meth)acrylate, glycidyloxy ethyl(meth)acrylate, glycidyloxy propyl(meth) acrylate, tetrahydrofurfuryl(meth)acrylate, hydroxy alkyl (meth)acrylate, 2-hydroxyl ethyl(meth)acrylate, 3-hydroxy propyl(meth)acrylate, 2-hydroxy propyl(meth)acrylate, 2-hydroxy butyl(meth)acrylate, 4-hydroxy butyl(meth)acrylate, dimethyl aminoethyl(meth)acrylate, diethyl aminoethyl (meth)acrylate, dimethyl amino propyl(meth)acrylate, diethyl amino propyl(meth)acrylate, trimethoxysilyl propyl (meth)acrylate, dicyclo pentenyl(meth)acrylate, dicyclo pentenyl oxyethyl(meth)acrylate, trimethoxysilyl propyl (meth)acrylate, trimethylsilyl propyl(meth)acrylate, polyethylene oxide monomethyl ether(meth)acrylate, oligoethylene oxide monomethyl ether(meth)acrylate, polyethylene oxide(meth)acrylate, oligoethylene oxide(meth)acrylate, oligoethylene oxide monoalkyl ether(meth)acrylate, polyethylene oxide monoalkyl ether(meth)acrylate, dipropylene glycol(meth)acrylate, polypropylene oxide monoalkyl ether (meth)acrylate, oligopropylene oxide monoalkyl ether (meth)acrylate, 2-methacryloyloxy ethyl succinic acid, 2-methacryloyloxy hexahydro phthalic acid, 2-methacryloyloxy ethyl 2-hydroxy propyl phthalate, butoxy dietylene glycol(meth)acrylate, trifluoroethyl(meth)acrylate, perfluoro octylethyl(meth)acrylate, 2-hydroxy-3-phenoxy propyl (meth)acrylate, EO Modified phenol(meth)acrylate, EO Modified cresol(meth)acrylate, EO Modified nonyl phenol (meth)acrylate, PO Modified nonyl phenol(meth)acrylate, and EO Modified-2-ethyl hexyl(meth)acrylate.

As a multifunctional (meth)acrylate, there are two-functional (meth)acrylates such as 1,6-hexanediol di(meth)acrylate, 1,10-decanediol di(meth)acrylate, neopentyl glycol di(meth)acrylate, dipropylene glycol di(meth)acrylate (DPGD (M) A), tripropylene glycol di(meth)acrylate (TPGD (M) A), 2,4-dimethyl-1,5-pentanediol di(meth)acrylate, butyl ethyl propanediol di(meth)acrylate, ethoxylated cyclo hexanemethanol di(meth)acrylate, triethylene glycol di(meth)acrylate (TEGD (M) A), polyethylene glycol di(meth) acrylate, oligoethylene glycol di(meth)acrylate, ethylene glycol di(meth)acrylate, 2-ethyl-2-butyl butanediol di(meth) acrylate, hydroxy pivalic acid neopentyl glycol di(meth) acrylate, dimethylol tricyclo decane di(meth)acrylate, EO Modified bisphenol A di(meth)acrylate, bisphenol F polyethoxy di(meth)acrylate, polypropylene glycol di(meth) acrylate, oligopropylene glycol di(meth)acrylate, 1,4-butanediol di(meth)acrylate, 2-ethyl-2-butyl propanediol di(meth)acrylate, 1,9-nonanediol di(meth)acrylate, propoxylated ethoxylated bisphenol A di(meth)acrylate, and tricyclo decane di(meth)acrylate.

In addition, as a multi-functional (meth)acrylate, there are three-functional (meth)acrylates such as trimethylol propane tri(meth)acrylate, trimethylol ethane tri(meth)acrylate, alkylene oxide modified tri(meth)acrylate of trimethylol propane, penta erythritol tri(meth)acrylate, dipenta erythritol tri(meth)acrylate, trimethylol propane tri((meth)acryloyl oxypropyl) ether, isocyanuric acid alkylene oxide modified tri(meth)acrylate, propionic acid dipenta erythritol tri(meth) acrylate, tri((meth)acryloyl oxyethyl) isocyanurate, hydroxy pivalic aldehyde modified dimethylol propane tri(meth) acrylate, sorbitol tri(meth)acrylate, propoxylated trimethylol propane tri(meth) acrylate, and ethoxylated glycerine tri (meth)acrylate, four-functional (meth)acrylates such as penta erythritoltetra(meth)acrylate, sorbitol tetra(meth)acrylate, ditri methylol propanetetra(meth)acrylate, propionic acid dipenta erythritoltetra(meth)acrylate, and ethoxylated penta erythritoltetra(meth)acrylate, five-functional (meth) acrylates such as sorbitolpenta(meth)acrylate, and dipenta erythritolpenta(meth)acrylate, six-functional (meth)acrylates such as dipenta erythritol hexa(meth)acrylate, sorbitol hexa(meth)acrylate, alkylene oxide modified hexa(meth) acrylate of phosphazene, and caprolactone modified dipenta erythritol hexa(meth)acrylate, and the like.

As a (meth)acrylamide series, there are (meth)acrylamide, N-methyl(meth)acrylamide, N-ethyl(meth)acrylamide, N-propyl(meth)acrylamide, N-n-butyl(meth)acrylamide, N-t-butyl(meth)acrylamide, N-butoxy methyl(meth)acrylamide, N-isopropyl(meth)acrylamide, N-methylol(meth) acrylamide, N,N-dimethyl(meth)acrylamide, N,N-diethyl (meth)acrylamide, and (meth)acryloyl morpholine.

The N-vinyl compound has a structure (>N—CH═$CH_2$) where a vinyl group is bound to nitrogen. As a specific example of the N-vinyl compound, there are, for example, N-vinyl formamide, N-vinylcarbazole, N-vinylindole, N-vinylpyrrole, N-vinyl acetamide, N-vinyl pyrrolidone, N-vinyl caprolactam, and derivatives thereof. Among these compounds, the N-vinyl caprolactam is particularly preferred.

As a group having the photo cationic polymerization property, there are an epoxy ring, an oxetane ring, an oxolane ring, a dioxolane ring, and a vinyl ether group. The epoxy ring is preferred in the point that the curing speed of an aromatic material and an alicyclic material is excellent, and an alicyclic epoxy ring is particularly preferred.

As a specific example of the polymerizable compound having the cationic polymerization property, as a cationic polymerizable compound, there are an epoxy compound, a vinyl ether compound, an oxetane compound, and the like.

The amount of containing the polymerizable compound in the photo-curable ink composition is appropriately equal to or larger than 5 wt % and equal to or smaller than 95 wt % over a total amount of the photo-curable ink composition, preferably equal to or larger than 7 wt % and equal to or smaller than 90 wt %, and more preferably equal to or larger than 10 wt % and equal to or smaller than 80 wt %.

1.5.2. Photo Polymerization Initiator

The photo-curable ink composition according to the embodiment contains a photo polymerization initiator. As the photo polymerization initiator, there is a material which generates active species initiating polymerization of the polymerizable compound by light.

As the photo polymerization initiator (photo radical polymerization initiator) which generates a radical by light, an initiator in the related art such as arylalkyl ketone, oxime ketone, thiobenzoic acid S-phenyl, titanocene, aromatic ketone, thioxanthone, benzil and quinine derivatives, and ketocumarin series may be used.

As a specific example of the photo radical polymerization initiator, there are acetophenone, 2,2-diethoxy acetophenone, p-dimethyl amino acetophenone, benzophenone, 2-chlorobenzophenone, dichlorobenzophenone, p, p'-bis diethyl amino benzophenone, Michler's ketone, benzil, benzoin, benzoin methyl ether, benzoin ethyl ether, benzoin isopropyl ether, benzoin n-propyl ether, benzoin isobutyl ether, benzoin n-butyl ether, benzil methyl ketal, 2,2-dimethoxy-1,2-diphenyl ethane-1-one, 1-hydroxy cyclo hexyl phenyl ketone, 2-hydroxy-1-{4-[4-(2-hydroxy 2-methyl propionyl)benzil]phenyl}2-methyl propane-1-one, 2-benzil-2-dimethyl amino-1-(4-morpholino phenyl) butanone 1,2-dimethyl amino-2-(4-methylbenzil)-1-(4-morpholine-4-yl-phenyl) butane-1-one, 2,4,6-trimethyl benzoyl diphenyl phosphine oxide, bis(2,4,6-trimethyl benzoyl)phenyl phosphine oxide, bis(2,6-dimethoxy benzoyl)-2,4,4-trimethyl pentyl phosphine oxide, 2-methyl-1-[4-(methylthio)phenyl] 2-morpholino propane 1-one, thioxanthone, 2-chlorothioxanthone, 2-hydroxy-2-methyl-1-phenyl-1-one, 1-(4-isopropyl phenyl)-2-hydroxy-2-methyl propane-1-one, methyl benzoyl formate, azobisisobutyronitrile, benzoyl peroxide, di-tert-butyl peroxide, and the like.

As a commercialized product of the photo radical polymerization initiator, there are, for example, IRGACURE 651 (2,2-dimethoxy-1,2-diphenyl ethane-1-one), IRGACURE 184 (1-hydroxy-cyclo hexyl-phenyl-ketone), DAROCUR 1173 (2-hydroxy-2-methyl-1-phenyl-propane-1-one), IRGACURE 2959 (1-[4-(2-hydroxy ethoxy)-phenyl]-2-hydroxy-2-methyl-1-propane-1-one), IRGACURE 127 (2-hydroxy-1-{4-[4-(2-hydroxy-2-methyl propionyl)-benzil]phenyl}-2-methyl-propane-1-one), IRGACURE 907 (2-methyl-1-(4-methylthio phenyl)-2-morpholino propane 1-one), IRGACURE 369 (2-benzil-2-dimethyl amino-1-(4-morpholino phenyl)-butane-1), IRGACURE 379 (2-(dimethyl amino)-2-[(4-methyl phenyl)methyl]-1-[4-(4-morpholinyl) phenyl]-1-butanone), DAROCUR TPO (2,4,6-trimethyl benzoyl-diphenyl-phosphine oxide), IRGACURE 819 (bis (2,4,6-trimethyl benzoyl)-phenyl phosphine oxide), IRGACURE 784 (bis(115-2,4-cyclopentadiene 1-yl)-bis(2,6-difluoro-3-(1H-pyrrole 1-yl)-phenyl) titanium), IRGACURE OXE 01 (1,2-octanedione, 1-[4-(phenylthio)-, 2-(0-benzoyl oxime)]), IRGACURE OXE 02 (ethanone, 1-[9-ethyl-6-(2-methyl benzoyl)-9H-carbazole 3-yl]-, 1-(O-acetyl oxime)), IRGACURE 754 (a mixture of oxyphenyl acetic acid, 2-[2-oxo-2-phenyl acetoxy ethoxy]ethyl ester and oxyphenyl acetic acid, 2-(2-hydroxy ethoxy)ethyl ester) (hereinbefore, the listed products are manufactured by Ciba Japan K.K), DETX-S (2,4-diethyl thioxanthone) (manufactured by Nippon Kayaku Co., Ltd.), Lucirin TPO, LR8893, LR8970 (hereinbefore, the listed products are manufactured by BASF), and Ebecryl P36 (manufactured by UCB).

As the photo polymerization initiator (photo cationic polymerization initiator) which generates cations (acid) by light, there are an onium salt such as arylsulfonium salt or aryliodonium salt, a sulfonic acid generating initiator such as o-nitro benzyl tosylate, arylsulfonate p-nitrobenzil ester, and sulfonium acetophenone derivatives, an allene-ion complex derivative such as an iron-allene complex, a diazonium salt derivative, a triazine-series initiator, and an acid generating agent such as hilides. In specific examples of the photo cationic polymerization initiator, as an aryl sulfonium salt derivative, there are CYRACURE UVI-6990 and CYRACURE UVI-6974 (manufactured by Union Carbide), ADECA OPTOMER SP-150, ADECA OPTOMER SP-152, ADECA OPTOMER SP-170, and ADECA OPTOMER SP-172 (manufactured by Asahi Denka Kogyou K.K.), and the like; and as an aryl iodonium salt derivative, there are RP-2074 (manufactured by Rodia Co., Ltd.) and the like; and as an allene-ion complex derivative, there are IRGACURE 261 (manufactured by Chiba-Geigy) and the like.

The amount of containing the polymerization initiator in the photo-curable ink composition is preferably in the range of 1 wt % or more to 20 wt % or less with respect to a total of the photo-curable ink composition, and more preferably, in the range of 3 wt % or more to 15 wt % or less, By using the above range, it is possible to obtain the effect of retaining the curing property without deterioration in the mechanical strength of the cured photo-curable ink composition. As the photo polymerization initiator, a material which is sensitive to the illumination light may be appropriately selected and used. In addition, a degree of pinning of the liquid droplets of the photo-curable ink composition may be adjusted according to the type and the mixed amount of the photo polymerization initiator. For example, in the case where the degree of the pinning is desired to be small, although the degree of the pinning may be adjusted by decreasing the light amounts of the first light source 21 and the second light source 22, the decrease in the degree of the pinning may be performed by decreasing the mixed amount of the photo polymerization initiator within the aforementioned range.

With respect to the polymerizable compound and the photo polymerization initiator, the photo radical polymerization initiator is used for photo polymerization of the photo radical polymerizable compound, and the photo cationic polymerization initiator is used for photo polymerization of the photo cationic polymerizable compound. In the case where the photo radical polymerizable compound and the photo cationic polymerizable compound are simultaneously used, the photo radical polymerization initiator and the photo cationic polymerization initiator are simultaneously used.

1.5.3. Other Components 1.5.3.1. Colorant

The photo-curable ink composition according to the embodiment may contain a colorant and a dispersant.

In this case, the colorant includes a pigment and a dye, and a colorant which is used for a general ink may be used without particular limitation.

The ink composition according to the embodiment may further include a colorant. Although the colorant is selected among the pigment and the dye, it is preferable that the pigment is used in terms of light resistance. In the embodiment, the pigment is used as the colorant, so that it is possible to improve the light resistance of the ink composition. As the pigment, both of an inorganic pigment and an organic pigment may be used. The colorant is preferably in the range of 1 to 10 wt % in the ink composition, more preferably, in the range of 1 to 5 wt %.

As an inorganic pigment, a carbon black (C.I. pigment black 7) series pigment such as a furnace black, a lamp black, an acetylene black, and a channel black, iron oxide, and titanium oxide may be used.

In addition, as an organic pigment, there are an azo pigment such as an insoluble azo pigment, a condensed azo pigment, an azo lake pigment, and a chelate azo pigment, a polycyclic pigment such as a phthalocyanine pigment, perylene and perione pigments, an anthraquinone pigment, a quinacridone pigment, a dioxane pigment, a thioindigo pigment, an isoindolinone pigment, and a quinophtalone pigment, a dye chelate (for example, a basic dye type chelate, an acidic dye type chelate, and the like), a dye lake (a basic dye type lake and an acidic dye type lake), a nitro pigment, a nitroso pigment, an aniline black, and a daylight fluorescent pigment. One type of the pigment may be individually used, and two or more types thereof may be simultaneously used.

More specifically, as an inorganic pigment used for black, there are following carbon blacks, for example, No. 2300, No. 900, MCF88, No. 33, No. 40, No. 45, No. 52, MA7, MA8, MA100, No2200B, or the like (manufactured by Mitsubishi Chemical Corp.); Raven5750, Raven5250, Raven5000, Raven3500, Raven1255, Raven700, or the like (manufactured by Columbia Co., Ltd.); Regal 400R, Regal 330R, Regal 660R, Mogul L, Monarch 700, Monarch 800, Monarch 880, Monarch 900, Monarch 1000, Monarch 1100, Monarch 1300, Monarch 1400, or the like (manufactured by Cabot Co., Ltd.); or Color Black FW1, Color Black FW2, Color Black FW2V, Color Black FW18, Color Black FW200, Color Black 5150, Color Black 5160, Color Black 5170, Printex 35, Printex U, Printex V, Printex 140U, Special Black 6, Special Black 5, Special Black 4A, Special Black 4, or the like (manufactured by Degussa Corp.).

As an organic pigment for yellow, there are C.I.Pigment Yellow 1, C.I.Pigment Yellow 2, C.I.Pigment Yellow 3, C.I.Pigment Yellow 4, C.I.Pigment Yellow 5, C.I.Pigment Yellow 6, C.I.Pigment Yellow 7, C.I.Pigment Yellow 10, C.I.Pigment Yellow 11, C.I.Pigment Yellow 12, C.I.Pigment Yellow 13, C.I.Pigment Yellow 14, C.I.Pigment Yellow 16, C.I.Pigment Yellow 17, C.I.Pigment Yellow 24, C.I.Pigment Yellow 34, C.I.Pigment Yellow 35, C.I.Pigment Yellow 37, C.I.Pigment Yellow 53, C.I.Pigment Yellow 55, C.I.Pigment Yellow 65, C.I.Pigment Yellow 73, C.I.Pigment Yellow 74, C.I.Pigment Yellow 75, C.I.Pigment Yellow 81, C.I.Pigment Yellow 83, C.I.Pigment Yellow 93, C.I.Pigment Yellow 94, C.I.Pigment Yellow 95, C.I.Pigment Yellow 97, C.I.Pigment Yellow 98, C.I.Pigment Yellow 99, C.I.Pigment Yellow 108, C.I.Pigment Yellow 109, C.I.Pigment Yellow 110, C.I.Pigment Yellow 113, C.I.Pigment Yellow 114, C.I.Pigment Yellow 117, C.I.Pigment Yellow 120, C.I.Pigment Yellow 124, C.I.Pigment Yellow 128, C.I.Pigment Yellow 129, C.I.Pigment Yellow 133, C.I.Pigment Yellow 138, C.I.Pigment Yellow 139, C.I.Pigment Yellow 147, C.I.Pigment Yellow 151, C.I.Pigment Yellow 153, C.I.Pigment Yellow 154, C.I.Pigment Yellow 167, C.I.Pigment Yellow 172, C.I.Pigment Yellow 180, and the like.

As an organic pigment for magenta, there are C.I.Pigment Red 1, C.I.Pigment Red 2, C.I.Pigment Red 3, C.I.Pigment Red 4, C.I.Pigment Red 5, C.I.Pigment Red 6, C.I.Pigment Red 7, C.I.Pigment Red 8, C.I.Pigment Red 9, C.I.Pigment Red 10, C.I.Pigment Red 11, C.I.Pigment Red 12, C.I.Pigment Red 14, C.I.Pigment Red 15, C.I.Pigment Red 16, C.I.Pigment Red 17, C.I.Pigment Red 18, C.I.Pigment Red 19, C.I.Pigment Red 21, C.I.Pigment Red 22, C.I.Pigment Red 23, C.I.Pigment Red 30, C.I.Pigment Red 31, C.I.Pigment Red 32, C.I.Pigment Red 37, C.I.Pigment Red 38, C.I.Pigment Red 40, C.I.Pigment Red 41, C.I.Pigment Red 42, C.I.Pigment Red 48 (Ca), C.I.Pigment Red 48 (Mn), C.I.Pigment Red 57 (Ca), C.I.Pigment Red 57:1, C.I.Pigment Red 88, C.I.Pigment Red 112, C.I.Pigment Red 114, C.I.Pigment Red 122, C.I.Pigment Red 123, C.I.Pigment Red 144, C.I.Pigment Red 146, C.I.Pigment Red 149, C.I.Pigment Red 150, C.I.Pigment Red 166, C.I.Pigment Red 168, C.I.Pigment Red 170, C.I.Pigment Red 171, C.I.Pigment Red 175, C.I.Pigment Red 176, C.I.Pigment Red 177, C.I.Pigment Red 178, C.I.Pigment Red 179, C.I.Pigment Red 184, C.I.Pigment Red 185, C.I.Pigment Red 187, C.I.Pigment Red 202, C.I.Pigment Red 209, C.I.Pigment Red 219, C.I.Pigment Red 224, C.I.Pigment Red 245, C.I.Pigment Violet 19, C.I.Pigment Violet 23, C.I.Pigment Violet 32, C.I.Pigment Violet 33, C.I.Pigment Violet 36, C.I.Pigment Violet 38, C.I.Pigment Violet 43, C.I.Pigment Violet 50, and the like.

As an organic pigment for cyan, there are C.I.Pigment Blue 1, C.I.Pigment Blue 2, C.I.Pigment Blue 3, C.I.Pigment Blue 15, C.I.Pigment Blue 15:1, C.I.Pigment Blue 15:2, C.I.Pigment Blue 15:3, C.I.Pigment Blue 15:34, C.I.Pigment Blue 15:4, C.I.Pigment Blue 16, C.I.Pigment Blue 18, C.I.Pigment Blue 22, C.I.Pigment Blue 25, C.I.Pigment Blue 60, C.I.Pigment Blue 65, C.I.Pigment Blue 66, C.I.Vat Blue 4, C.I.Vat Blue 60, and the like.

In addition, As an organic pigment except for magenta, cyan, and yellow, there are, for example, C.I.Pigment Green 7, C.I.Pigment Green 10, C.I.Pigment Brawn 3, C.I.Pigment Brawn 5, C.I.Pigment Brawn 25, C.I.Pigment Brawn 26, C.I.Pigment Orange 1, C.I.Pigment Orange 2, C.I.Pigment Orange 5, C.I.Pigment Orange 7, C.I.Pigment Orange 13, C.I.Pigment Orange 14, C.I.Pigment Orange 15, C.I.Pigment Orange 16, C.I.Pigment Orange 24, C.I.Pigment Orange 34, C.I.Pigment Orange 36, C.I.Pigment Orange 38, C.I.Pigment Orange 40, C.I.Pigment Orange 43, C.I.Pigment Orange 63, and the like.

In the embodiment, besides the above exemplified organic pigments, water-insoluble or poorly water-soluble dyes such as dispersive dyes or oil-soluble dyes may be very appropriately used.

In the case where the aforementioned pigment is used as a colorant of a recording ink for the ink jet, an average particle size is preferably 500 nm or less, more preferably, 200 nm or less, and furthermore preferably, in the range of 50 to 100 nm. If the average particle size of the core material is in such a range, the effect of reliability such as ejection stability or dispersion stability of the recording ink for the ink jet may be obtained, and a high-quality image may be output.

In the case where the colorant is contained in the photo-curable ink composition according to the embodiment, the addition amount of the colorant is preferably in the range of about 0.1 wt % or more to about 25 wt % or less, more preferably, in the range of about 0.5 wt % or more to about 15 wt % or less. In addition, the degree of the pinning of the liquid droplets of the photo-curable ink composition may be adjusted according to the type and the mixed amount of the colorant. For example, in the case where the degree of the pinning is desired to be small, although the degree of the pinning may be adjusted by decreasing the light amounts of the first light source 21 and the second light source 22, the decrease in the degree of the pinning may be performed by selecting the exemplified type of the colorant or by changing the mixed amount of the colorant within the aforementioned range.

In addition, in the case where a pigment is contained the photo-curable ink composition, a pigment dispersing solution which is obtained by dispersing the pigment with a dispersant or a surfactant in a medium may be used. In addition, in order to allow the pigment to be contained in the photo-curable ink composition, the pigment and the dispersant or the surfactant may be allowed to be contained. As a preferred dispersant, a dispersant generally used to produce a pigment dispersing solution, for example, a polymeric dispersant may be used.

As the dispersant, it is possible to use an arbitrary dispersant which is used for a general ink. As such a dispersant, it is possible to use a commercialized product, and specific examples thereof include polyester-series polymeric compounds such as Hinoacto KF1-M, T-6000, T-7000, T-8000, T-8350P, T-8000EL (manufactured by Takefu Fine Chemicals Co., LTd.), Solsperse 13940, 20000, 24000, 32000, 32500, 33500, 34000, 35200, 36000 (manufactured by Lubrizol Corp.), Disperbyk-161, 162, 163, 164, 166, 180, 190, 191, 192 (manufactured by BYK Chemie Co., Ltd.), FLOWLEN DOPA-17, 22, 33, G-700 (manufactured by Kyoeisha Chemical Co., Ltd.), AJISPER PB821, PB711 (manufactured by Ajinomoto Co., Inc), LP4010, LP4050, LP4055, POLYMER 400, 401, 402, 403, 450, 451, 453 (manufactured by EFKA chemicals Company), or a mixture thereof.

In the case where the dispersant is contained in the photo-curable ink composition, the amount thereof may be appropriately selected according to a to-be-dispersed coloring material so as to be in the range of 5 wt % or more to 200 wt % or less, and more preferably, in the range of 30 wt % or more to 120 wt % or less with respect to the amount of containing a coloring material (particularly, a pigment) in the photo-curable ink composition.

1.5.3.2. Additive Agent

A polymerization promoter may be contained in the photo-curable ink composition which is configured with the photo radical polymerizable compound according to the embodiment. In the case of the photo radical polymerization, the polymerization promoter is not particularly limited, but there are Darocur EHA, EDB (manufactured by Chiba Specialty Chemicals Corp.), EBECRYL 7100 (manufactured by Daicel Cytec Co., Ltd.), and the like.

In addition, a thermal radical polymerization inhibitor may be contained in the photo-curable ink composition which is configured with the photo radical polymerizable compound. Accordingly, it is possible to improve storage stability of the photo-curable ink composition. Specific examples of the thermal radical polymerization inhibitor include methyl ether hydroquinone (MEHQ) (manufactured by Kanto Chemical Co., Ltd), tert-butyl-p-benzoquinone, Irgastab UV-10, UV-22 (manufactured by Chiba Specialty Chemicals Corp.), and the like.

Furthermore, a surfactant may be contained in the photo-curable ink composition. A surfactant which may be dissolved in the photo polymerizable compound is preferred. A silicon-series surfactant or a fluorine-series surfactant may be used. As the silicon-series surfactant, polyether modified polydimethyl siloxane or polyester modified polydimethyl siloxane may be used. Specific examples of the silicon-series surfactant include BYK-347, BYK-348, BYK-UV3500, 3510, 3530, 3570 (manufactured by BYK Chemie Japan Co., Ltd.), UV-3500 (manufactured by Chiba Specialty Chemicals Corp.), and the like. The surfactant may also function as a slipping agent. In the case where the surfactant is added, the preferred addition amount is in the range of 0.5 wt % or more to 4.0 wt % or less in the ink composition.

Furthermore, the photo-curable ink composition according to the embodiment may be added with a UV absorber, a leveling agent, or the like if necessary.

1.6. Curing of Photo-Curable Ink Composition

The photo-curable ink composition according to the embodiment contains at least the polymerizable compound and the polymerization initiator. Therefore, the photo-curable ink composition may be cured by being illuminated with light from the first light source 21, the second light source 22, and the like.

In the case where UV light is used as the light of the light source, the UV light on the photo-curable ink composition is emitted in such a range that the final illumination amount thereof is in the range of 10 mJ/cm$^2$ or more to 20,000 mJ/cm$^2$ or less, more preferably, in the range of 50 mJ/cm$^2$ or more to 15,000 mJ/cm$^2$ or less. If the illumination amount of the UV light is set to be in the above range, it is possible to perform sufficient curing reaction of the polymerizable compound.

In the ink jet recording apparatus 100 according to the embodiment, the photo-curable ink composition is pinned by the light of the first light source 21 and the second light source 22. With respect to the curing ratio at the time of the pinning, if the curing ratio is set to 100% at the time when the photo-curable ink composition is assumed to be entirely cured in the curing reaction, the light illumination amount at this time may be set to 100%. In addition, if a calibration curve of the curing ratio with respect to the light illumination amount for the to-be-used photo-curable ink composition is prepared in advance, the light illumination amounts of the first light source 21 and the second light source may be set so that the liquid droplets of the photo-curable ink composition have a desired curing ratio. In addition, the conversion ratio of the photo-curable ink composition may be obtained from a changing value of the absorbance in the peak of a specific absorption spectrum by using, for example, an FT-IR (Fourier Transform Infrared Spectrometer).

1.7. Function and Effect

In the ink jet recording apparatus according to the embodiment, the first light source 21 and the second light source 22 are provided, so that two-step preliminary curing (pinning) may be performed on the photo-curable ink composition before the main curing. Therefore, it is possible to easily control the color bleeding, the definition, and the glossiness of the image formed on the recording medium. Accordingly, it is possible to form an image having small color bleeding and good definition and glossiness on the recording medium by using, for example, a photo-curable ink composition. In addition, in the ink jet recording apparatus according to the embodiment, the first light source 21 and the second light source 22 are disposed by specific distances from the head 10, so that it is possible to perform the aforementioned two-time pinning in the state where each of the light sources is turned on. In other words, it is possible to perform good pinning without control of the light blinking of each of the light sources.

2. Ink Jet Recording Method

The ink jet recording method according to the embodiment includes a process of ejecting the aforementioned photo-curable ink composition by using the aforementioned ink jet recording apparatus and applying the photo-curable ink composition on a recording medium. In addition, more specifically, the ink jet recording method according to the embodiment includes: applying the liquid droplets on the recording medium P by relatively scanning the head 10 in the first direction with respect to the recording medium P and by ejecting the liquid droplets I of the photo-curable ink composition from the nozzle holes of the head; illuminating the liquid droplets I applied to the recording medium P with light from the first light source 21 disposed to be separated by the first distance G1 from the nozzle hole 12 located at the one side end of the head 10 in the first direction; and illuminating the liquid droplets I applied to the recording medium P with light from the second light source 22 disposed to be separated by the second distance G2 on the side opposite the head 10 with respect to the first light source 21, wherein the liquid droplets I are illuminated with the light of the first light source 21 after a time interval of 0.001 seconds or more to 1 second or less elapses from the time when the liquid droplets I are applied on the recording medium P, wherein the liquid droplets are illuminated with the light of the second light source 22 after a time interval of 0.1 seconds or more to 1 second or less elapses from the time when the liquid droplets are illuminated with light of the first light source 21, so that the photo-curable ink composition is cured in the curing ratio of 1% or more to 30% or less by the light of the first light source 21 and the photo-curable ink composition is cured in the curing ratio of more than 30% to 80% or less by the light of the second light source 22.

Hereinafter, an example of ink jet recording method of forming dot groups by ejecting the photo-curable ink composition on the recording medium P by using the ink jet recording apparatus 100 to apply the dot groups to the recording medium P is illustrated.

The ink jet recording method according to the embodiment includes a liquid droplet ejection process of ejecting the liquid droplets of the photo-curable ink composition from the head 10; a first illumination process of illuminating the liquid droplets with the light from the first light source 21; and a second illumination process of illuminating the liquid droplets with the light from the second light source 22.

2.1. Liquid Droplet Ejection Process

In this process, liquid droplets are applied to the recording medium P by ejecting the photo-curable ink composition as the liquid droplets from the head 10 of the ink jet recording apparatus 100.

In the ink jet recording method according to the embodiment, an amount of the liquid droplets ejected from one nozzle hole 12 of the head 10 is preferably in the range of 1 pl or more to 20 pl or less. The amount of the liquid droplets is set to be in the aforementioned range, so that it is possible to obtain an image having a good ejection stability and a higher image quality. In FIG. 2, the liquid droplets I applied to the recording medium P by this process are illustrated.

2.2. Illumination Process

2.2.1. First Illumination Process

In this process, the liquid droplets applied to the recording medium P are illuminated with light by the first light source 21. Hereinafter, this process is described in the case where the head 10 is moved, for example, in the direction of the arrow A in the scanning direction MS of the head 10 illustrated in FIG. 2.

The head 10 is moved in the direction of the arrow A of the figure, so that the liquid droplets I applied to the recording medium P by the liquid droplet ejection process are moved to the position where the liquid droplets I are illuminated with light by one of the first light sources 21. As a result, the liquid droplets I are illuminated with the light of the first light source 21. Due to this process, the curing reaction of the photo-curable ink composition constituting the liquid droplets I proceeds, so that the first pinning of the liquid droplets I is obtained. In addition, although not shown, in the embodiment, since the first light sources 21 are disposed to both sides of the head in the scanning direction, even in the case where the movement directions of the head 10 and the recording medium P are reverse to those of the above-exemplified case, the same process proceeds.

The first illumination process may very simply performed by using the aforementioned ink jet recording apparatus 100. In addition, after a time interval of 0.001 seconds or more to less than 1 second elapses from the time when the liquid droplet ejection process is ended, the first illumination process is performed. In addition, the relative scanning speed of the head 10 and the recording medium P is set to be in the range of 1 m/minute or more to 50 m/minute or less, so that it is possible to more effectively perform the curing of the liquid droplets of the photo-curable ink composition. Accordingly, it is possible to improve, for example, rub-fastness or the like of a to-be-formed image.

The degree of the pinning of the liquid droplets I by the first illumination process is set to be in the range of 1% or more to less than 30% as the curing ratio of the photo-curable ink composition constituting the liquid droplets I. Accordingly, it is possible to reduce unnecessary wetting and spreading of the liquid droplets I on the recording medium P or to reduce unnecessary color bleeding, and it is possible to induce controlled wetting and spreading and color bleeding. The degree of the pinning of the liquid droplets I by the first illumination process is preferably in the range of 1% or more to less than 10% as the curing ratio, more preferably, in the range of 1% or more to less than 5%.

2.2.2. Second Illumination Process

In this process, liquid droplets applied to the recording medium P are illuminated with light by the second light source 22. Hereinafter, this process is described in the case where the head 10 is moved, for example, in the direction of the arrow A in the scanning direction MS of the head 10 illustrated in FIG. 2. Note that the arrow B corresponds to a reverse direction of the arrow A.

The head 10 is moved in the direction of the arrow A in the figure continuously after the first illumination process is ended, so that the liquid droplets I applied to the recording medium P by the liquid droplet ejection process are moved to the position where the liquid droplets I are illuminated with light by one of the second light sources 22. As a result, the liquid droplets I are illuminated with light of the second light source 22. With this process, the curing reaction of the photo-curable ink composition constituting the liquid droplets I proceeds, so that the second pinning of the liquid droplets I is obtained. In addition, although not shown, in the embodiment, since the second light sources 22 are disposed on both sides of the head 10 in the scanning direction, even in the case where the movement directions of the head 10 and the recording medium P are reverse to those of the above-exemplified case, the same process proceeds.

The second illumination process may be performed without difficulty by using the aforementioned ink jet recording apparatus 100. In addition, after a time interval of 0.1 seconds or more to less than 1 second elapses from the time when the first illumination process is ended, the second illumination process is performed. In addition, the relative scanning speed of the head 10 and the recording medium P is set to be in the range of 1 m/minute or more to 50 m/minute or less, so that it is possible to more effectively perform the curing of the liquid droplets of the photo-curable ink composition. Accordingly, it is possible to improve, for example, rub-fastness or the like of a to-be-formed image.

The degree of the pinning of the liquid droplets I by the second illumination process is set to be in the range of more than 30% to 80% or less as the curing ratio of the photo-curable ink composition constituting the liquid droplets I in combination with the curing ratio of the first illumination process. Accordingly, for example, in the case where the liquid droplets I on the recording medium P are formed to have a desired shape or a plurality of the liquid droplets I exist, the color bleeding thereof may be set to be a desired degree. In addition, the degree of the pinning by the second illumination process is preferably in the range of 40% or more to 80% or less as the conversion ratio, more preferably, in the range of 50% or more to 80% or less.

2.3. Other Processes

Third Illumination Process

The ink jet recording method according to the embodiment may include a third illumination process. The third illumination process is a process of illuminating the liquid droplets applied to the recording medium P with light by the third light source 23.

After at least one set of the first illumination process and the second illumination process is performed, the recording medium P is moved in the scanning direction SS, so that the liquid droplets I applied to the recording medium P by the liquid droplet ejection process is moved to the position where the liquid droplets I are illuminated with light of the third light source 23. As a result, the liquid droplets I are illuminated with light of the third light source 23. With this process, the curing reaction of the photo-curable ink composition constituting the liquid droplets I proceeds, so that the main curing of the liquid droplets I is performed. The main curing is the curing for obtaining the state where the recording material may be appropriately used. The curing ratio of the main curing is higher than the curing ratio by the pinning. The curing ratio of the main curing is 80% or more. In addition, if the recording material is used in the state of having the curing ratio of the pinning, the main curing may not be performed.

The third illumination process may be performed without difficulty by using the aforementioned ink jet recording apparatus 100. In the ink jet recording method according to the embodiment, since the aforementioned ink jet recording apparatus 100 is used, in the case where the aforementioned third illumination process is provided, the liquid droplets I are allowed to be applied to the recording medium P, and the two-times pinning and the main curing may be implemented by scanning the recording medium P and by scanning the head 10.

3. Experimental Examples

Hereinafter, although the invention is described in detail with reference to several experimental examples, these experimental examples do not limit the scope of the invention.

3.1. Photo-Curable Ink Composition

A photo-curable ink composition set common to the experimental examples is produced.

A polymerizable compound containing 29.5 wt % of phenoxy acrylate (V#192: manufactured by Osaka Organic Chemical Industry Ltd.), 19.7 wt % of dicyclo pentenyl oxy ethyl acrylate (FA512AS: manufactured by Hitachi Chemical Co., Ltd.), 15.8 wt % of dicyclo pentenyl acrylate (FA511AS: manufactured by Hitachi Chemical Co., Ltd.), 9.8 wt % of vinyl caprolactam, and 9.8 wt % of dimethylol tricyclo decane diacrylate (EBECRYL IRR 214K: manufactured by Daicel Cytec Co., Ltd.), a photo polymerization initiator containing 5 wt % of IRGACURE 819 (manufactured by Chiba Specialty Chemicals Corp.), 4 wt % of DAROCURE TPO (manufactured by Chiba Specialty Chemicals Corp.), and 1 wt % of DETX (manufactured by Nippon Hayaku Co., Ltd.), a polymerization promoter containing 3 wt % of EBECRYL 7100 (manufactured by Daicel Cytec Co., Ltd.), a slipping agent containing 0.2 wt % of BYK-UV3500 (manufactured by BYK Chemie Japan Co., Ltd.), a pigment dispersant containing 0.1 wt % of Solsperse 36000 (manufactured by Lubrizol Corp.), and a 2 wt % of a pigment are combined and mixed or dissolved and, after that, mixed and stirred with a magnetic stirrer for 30 minutes at a normal temperature under a normal pressure.

As a set of the photo-curable ink composition, the aforementioned pigments, that is, the pigment using cyan pigment: IRGALITE BLUE GLVO (manufactured by Chiba Specialty Chemicals Corp.), the pigment using magenta pigment: pigment red 122, the pigment using yellow pigment: pigment yellow 180, and the pigment using carbon black are used as one set.

In addition, after the photo-curable ink composition is obtained, a total of 2000 ppm of methyl ether hydroquinone (manufactured by Kanto Chemical Co., Ltd.) and tert-butyl-p-benzoquinone (manufactured by Chiba Specialty Chemicals Corp.) is added as a polymerization inhibitor, so that an ink set common to experimental examples is produced.

3.2. Ink Jet Recording Apparatus

The evaluation samples of the experimental examples are produced by using a modification of the serial-type ink jet printer PX-G920 (manufactured by Seiko Epson Corp.) as the ink jet recording apparatus. The aforementioned photo-curable ink composition set is introduced into the ink cartridge of each color in the printer. The printer includes a first light source, a second light source, and a third light source, each of which is configured with an LED having a wavelength of 395 nm through the modification. Therefore, similarly to the ink jet recording apparatus 100 described in the aforementioned embodiment, the first light source and the second light source are disposed at two sides of the head in the scanning direction MS.

3.3. Production of Evaluation Sample

The samples of the experimental examples are produced by using a vinyl chloride sheet cut by A4 size (one of the ISO (International Organization of Standardization) 216 sizes, A4 (210 mm×297 mm)) as the recording medium and by setting the light amount of each light source so that the curing ratios are obtained as listed in Table.

Any one of the samples is formed in a print mode of the media "Vinyl Chloride General 1" and the printing quality "good" as the settings of the printer, and a test pattern capable of evaluating a line width of one dot of each color and a tone of a beta portion and capable of evaluating bleeding (color bleeding) and glossiness is formed. In addition, the light amounts of the first illumination through the third illumination for each experimental example are adjusted by using the light amount of LEDs so that the curing ratios listed in Table are obtained. With respect to the curing ratio of the photo-curable ink composition in each of the experimental examples, the curing ratio at the time when the first illumination is performed, the curing ratio at the time when the illumination up to the second illumination is performed, and the curing ratio at the time when the illumination up to the third illumination is performed are obtained from the changing value of the absorbance in the peak of a specific spectrum by using an FT-IR (Fourier Transform Infrared Spectrometer). The scanning speed of the head is set to 10 m/minute. The distance between the nozzle hole nearest to the first light source and the nozzle hole farthest from the first light source among the nozzle holes aligned in the main scanning direction of the head is set to 30 mm. With respect to the ink in the aforementioned ink set, ink charging is performed one ink by one ink to one row of the arrays of the nozzle holes aligned in the first direction. For each experimental example, by changing the first distance G1 and the second distance G2, the time interval from the time when the liquid droplets land to the time when the first illumination is performed and the time interval from the time when the first illumination is ended to the time when the second illumination is performed are adjusted. Therefore, in Experimental Examples 1 to 18, the layout is formed so that the liquid droplets are illuminated with light from the first light source in a time interval of 0.001 seconds or more to 1 second or less after the liquid droplets of the photo-curable ink composition are applied to the recording medium. In addition, the liquid droplet ejected from the nozzle hole nearest to the first light source is subject to the first illumination earliest after the impact, and the liquid droplet ejected from the nozzle hole farthest from the first light source is subject to the first illumination latest after the impact. In Experimental Examples 1 to 15, 18, and 19, the layout is formed so that the liquid droplets are illuminated with light of the second light source in a time interval of 0.1 second or more to 1 second or less after the first illumination is ended.

TABLE

| | Curing Condition | | | | | | | |
|---|---|---|---|---|---|---|---|---|
| | Curing Ratio | | | Time Interval (second) | | Evaluation Result | | |
| | First Illumination Process | Second Illumination Process | Third Illumination Process | From Impact To First Illumination | From First Illumination To Second Illumination | Color Bleeding | Line Width | Glossiness |
| Example 1 | 20% | 55% | 95% | 0.06-0.24 | 1.0 | A | A | A |
| Example 2 | 20% | 55% | 95% | 0.06-0.24 | 0.1 | A | A | A |
| Example 3 | 30% | 80% | 95% | 0.06-0.24 | 0.1 | A | B | B |
| Example 4 | 10% | 35% | 95% | 0.06-0.24 | 0.1 | B | A | A |
| Example 5 | 7% | 65% | 95% | 0.06-0.24 | 0.1 | A | A | A |
| Example 6 | 1% | 40% | 95% | 0.06-0.24 | 0.1 | B | A | A |
| Example 7 | 3% | 40% | 95% | 0.06-0.24 | 0.1 | B | A | A |
| Example 8 | 3% | 10% | 95% | 0.06-0.24 | 0.1 | C | A | A |
| Example 9 | 10% | 20% | 95% | 0.06-0.24 | 0.1 | C | A | A |
| Example 10 | 55% | 90% | 95% | 0.06-0.24 | 0.1 | A | C | C |
| Example 11 | 10% | — | 95% | 0.06-0.24 | 0.1 | C | A | A |
| Example 12 | 10% | 95% | — | 0.06-0.24 | 0.1 | A | C | B |
| Example 13 | 16% | — | 95% | 0.06-0.24 | 0.1 | C | A | A |
| Example 14 | 40% | — | 95% | 0.06-0.24 | 0.1 | A | C | C |
| Example 15 | 0.05% | 40% | 95% | 0.06-0.24 | 0.1 | C | A | B |
| Example 16 | 20% | 55% | 95% | 0.06-0.24 | 1.5 | C | A | A |
| Example 17 | 20% | 55% | 95% | 0.06-0.24 | 0.06 | A | B | C |
| Example 18 | 20% | 55% | 95% | 0.82-1.0 | 0.5 | A | A | A |
| Example 19 | 20% | 55% | 95% | 1.0-1.18 | 0.3 | C | A | A |

3.4. Evaluation Method

With respect to the obtained samples of the experimental examples, the bleeding, the line width, and the glossiness are evaluated.

The bleeding is evaluated by viewing the test pattern by using a loupe or the like. A test pattern where each ink is printed to be adjacent to a test pattern of ink of other colors is produced. The test pattern is produced as 720×720 dpi. With respect to the test patterns produced by allowing different colors of ink to be adjacent to each other, the case where there is neither unclear boundary line in all the test patterns of the colors nor color bleeding between the adjacent test patterns is indicated by "A"; the case where there is a test pattern where the color bleeding occurs in the color boundary with respect to the adjacent test pattern is indicated by "B"; and the case where there is an unclear boundary line in the test pattern is indicated by "C". The results are listed in Table.

The line width is evaluated by viewing the test pattern by using a loupe or the like when dots are formed at all the pixels (minimum unit area where the dots are to be formed) aligned in the first direction in the test pattern. The case where a sufficient line width is obtained to bury the beta portion with the dot is indicated by "A"; the case where the line width is narrower than that of the case A but the beta portion is buried with the dot is indicated by "B"; and the case where the line width is narrow and the beta portion is not burred with the dot is indicated by "C". The results are listed in Table.

The glossiness is evaluated by viewing the test pattern. The test pattern having high glossiness is indicated by "A"; the test pattern having glossiness is indicated by and the test pattern having insufficient glossiness is indicated by "C". The results are listed in Table.

3.5. Evaluation Result

Referring to Table, it is proved that it is possible to significantly change the bleeding, the line width, and the glossiness by changing the curing ratios in the first illumination and the second illumination in each of the experimental examples. In other words, it is proved that, if the ink jet recording apparatus used in the experimental examples is used, it is possible to change the method of wetting and spreading the liquid droplets of the photo-curable ink composition applied to the recording medium and the shape of the surface in a wide range.

In addition, it is proved that all of the bleeding, the line width, and the glossiness of the samples of Experimental Example 1 to Experimental Example 7 are good. In other words, in the samples of which the conversion ratio of the photo-curable ink composition at the time of the first illumination is in the range of 1% to 30% and of which the conversion ratio of the photo-curable ink composition at the time of the second illumination is in the range of 35% to 80%, all the bleeding, the line width, and the glossiness are good.

The above-described embodiments and modified embodiments may be appropriately combined in an arbitrary plurality of aspects. Therefore, the combined embodiments may also provide the effects of the individual embodiment or increasing effects thereof.

The invention is not limited to the aforementioned embodiments, and various modifications are available. For example, the invention includes configurations substantially the same as the configurations described in the embodiments (for example, configurations of which the functions, the method, and the results are the same or configuration of which the object and advantages are the same). In addition, the invention includes configurations formed by substituting non-essential components in the configurations described in the embodiments. In addition, the invention includes configurations which provide the same functions and effect as those of the embodiment described above or configurations by which the same objects may be achieved. In addition, the invention includes configurations added with well-known technologies to the configurations described in the embodiments.

The invention claimed is:

1. An ink jet recording apparatus comprising:

a head which applies liquid droplets on a recording medium by being relatively scanned with respect to the recording medium in a first direction and by ejecting the liquid droplets of a photo-curable ink composition from nozzle holes; and a first light source and a second light source which are sequentially disposed along the first direction at a downstream side in a scanning direction of the head to illuminate the liquid droplets applied to the recording medium with light, wherein:

after the liquid droplets are applied to the recording medium, the liquid droplets are illuminated with light of the first light source, and after the illumination with light of the first light source, the liquid droplets are illuminated with light of the second light source, the recording medium is transported to the downstream side in the first direction, and the photo-curable ink composition has a photo radical polymerization property and contains at least one of an acrylic ester series having an acryloyl group.

2. The ink jet recording apparatus according to claim 1, wherein after one second or less elapses from the time when the liquid droplets are applied to the recording medium, the liquid droplets are illuminated by the first light source.

3. The ink jet recording apparatus according to claim 2, wherein after 0.1 second or more and one second or less elapses from the time when the liquid droplets are illuminated by the first light source, the liquid droplets are illuminated by the second light source.

4. The ink jet recording apparatus according to claim 3, wherein the photo-curable ink composition is cured to have a first curing ratio of 1% to 30% by the first light source, and the photo-curable ink composition is cured to have a second curing ratio of more than 30% and 80% or less by the second light source.

5. The ink jet recording apparatus according to claim 1, wherein after 0.1 second or more and one second or less elapses from the time when the liquid droplets are illuminated by the first light source, the liquid droplets are illuminated by the second light source.

6. The ink jet recording apparatus according to claim 1, wherein a relative scanning speed of the head with respect to the recording medium in the first direction is in a range of 1 m/minute to 50 m/minute.

7. The ink jet recording apparatus according to claim 1, wherein the photo-curable ink composition contains a mono-functional (meth)acrylate and a multifunctional (meth)acrylate.

8. The ink jet recording apparatus according to claim 1, wherein the photo-curable ink composition contains at least one of 2,4,6-trimethyl benzoyl-diphenyl-phosphine oxide and bis(2,4,6-trimethyl benzoyl)-phenyl phosphine oxide.

9. The ink jet recording apparatus according to claim 1, wherein the photo-curable ink composition is illuminated in a range of 50 mJ/cm$^2$ to 15,000 mJ/cm$^2$.

10. The ink jet recording apparatus according to claim 1, wherein after the liquid droplets are illuminated by a third light source, the photo-curable ink composition is cured to have a curing ratio of more than 80%.

* * * * *